United States Patent [19]

Varga

[11] 3,970,118

[45] July 20, 1976

[54] ROCK FASTENER MACHINE

[75] Inventor: Leroy M. Varga, Dover, N.J.

[73] Assignee: Rockaway Corporation, Rockaway, N.J.

[22] Filed: May 29, 1975

[21] Appl. No.: 581,762

[52] U.S. Cl. ..... 140/93 C; 140/74

[51] Int. Cl.[2] ..... B21F 27/14

[58] Field of Search..... 140/74, 93 C; 227/85, 227/91

[56] References Cited

UNITED STATES PATENTS

| | | | |
|---|---|---|---|
| 2,093,139 | 9/1937 | Rosenmund | 140/93 |
| 2,338,204 | 1/1944 | Rosenmund | 140/93 |

*Primary Examiner*—Lowell A. Larson

*Attorney, Agent, or Firm*—Pasquale A. Razzano

[57] ABSTRACT

In an apparatus for forming loop fasteners on wire-bound container blanks wherein wire manipulations are performed on a wire section secured to a container blank to form a loop in the wire and drive the end of the wire into the container blank to perpetuate the loop, first and second crossbars are provided which are respectively vertically reciprocally mounted above and transversely of the path of travel of the container blank with wire manipulating means mounted on the first crossbar including means for bending the wire section into a loop when the first crossbar is in its lowered position and means positioned to be engaged and driven by the second crossbar, during downward movement thereof, for forming a prong in the wire section, after the loop is formed, and driving the prong into the container blank material. The bending means bends the wire over a hook-like extension on a loop bar of the prong forming and driving means, and the latter includes a former bar that engages the end of the wire overlying the hook-like projection and bends it downwardly, in response to downward movement of the second crossbar, to form a prong which is supported on its inside by the hook-like extension and on its other three sides by the walls of a groove in the former bar. A driver bar then drives the formed prong through the face material of the container blank while camming the hook-like extension progressively out of the way.

50 Claims, 24 Drawing Figures

ROCK FASTENER MACHINE

The present invention relates to an apparatus for use in manufacturing wirebound boxes, and more particularly to an apparatus for manipulating a wire secured to a wire-bound container blank to provide the end of the wire with a loop or bight and to perpetuate the loop by driving the end of the wire into the face material of the container blank.

Wirebound container, box, or crate blanks, used to form completed wirebound containers, are customarily formed in stapling machines of the general type disclosed in U.S. Pat. No. 2,482,370 in which properly assembly face material or slats and reinforcing cleats are conveyed by continuously moving conveyor bands beneath stapling machine heads which drive stables astride longitudinally extending binding wires, through the face material or slats, and into the cleats to form a continuous succession of wirebound blanks each comprising several, usually four, side sections foldably secured together by the binding wires. This continuous succession is then typically fed into a loop forming machine of the type described in U.S. Pat. Nos. 1,933,091 and 3,702,146, wherein the binding wires are severed in the interval between adjacent blanks and bent to form loops whose free ends are then bent to form prongs which are driven into the face material of the blanks. When the blank is folded to set up the container the two loop fasteners at opposite ends of each of the binding wires come into position at the closing corner of the container and one of these loops, being somewhat narrower than the other, is inserted through the latter and bend down against the outer surface of the box to secure the container closed.

With the original prong forming and driving mechanisms in the art, there had been considerably difficulty in driving the prongs through the face material of the blank, particularly where the binding wire was of a relatively light gauge or where the face material of the blank was formed of a relatively hard wood. Under these conditions there was a tendency for the prong to buckle rather than to penetrate the face material. In addition, if the prong was not properly directed perpendicularly to the face material it could be laterally deflected and skid across the upper surface of the face material rather than penetrating it, thereby creating a "cull" or "reject" which required manual repair in an awkward and time consuming job.

These problems were substantially overcome by the improved prong forming and driving mechanism disclosed in U.S. Pat. No. 3,702,146 which utilizes a wire manipulating mechanism that includes a loop bar having a hook-like projection over which the free end of a looped wire is positioned for engagement by a former bar which bends the wire end downwardly to form a vertical prong supported on one side by the vertical inner face of the loop bar and on its other three sides by the walls of a vertical groove in the adjacent inner face of the former bar. Thereafter a driver bar engages the wire to drive the prong through the face material as the loop bar is moved in synchronism out of the path of the descending horizontal portion of the wire.

The prong forming and driving mechanism of U.S. Pat. No. 3,702,146 was constructed for use in a then existing loop fastener machine of the type shown in U.S. Pat. No. 1,933.031. Such machines could not form a "negative" loop on a wirebound box blank. That is, the machine could only form wire loops which extended beyond the edge of the wirebound box; they could not form loops within the confines of the periphery of the container blank. Such loops are often desired in the packaging industry since a somewhat more compact completed container can be formed thereby with less wire and with less wire exposed or projecting beyond the periphery of the container.

Accordingly, it is an object of the present invention to provide an improved loop forming and fastening machine for wirebound container blanks.

Another object of the present invention is to provide a loop forming and driving machine which is adapted to form both "positive" and "negative" loops.

A further object of the present invention is to provide a wire manipulating machine which is durable in construction and reliable in operation.

Another object of the present invention is to provide a wire manipulating machine containing a prong forming and driving mechanism which will support the prong on all sides while being driven.

A still further object of the present invention is to provide a wire manipulating mechanism of the character described which is relatively simple and inexpensive in construction but reliable and foolproof in operation.

In accordance with one aspect of the present invention an apparatus for forming loop fasteners on wirebound container blanks is provided wherein wire manipulations are performed on a wire section secured to a container blank to form a loop in the wire and drive the end of the wire into the container blank to perpetuate the loop. The apparatus includes a frame which defines a path of travel therethrough for the container blank. A pair of crossbars are respectively vertically reciprocally mounted in the frame and transversely to the path of travel of the container blank for movement between upper and lower positions. These bars are reciprocated vertically in accordance with a predetermined sequence.

A wire manipulating mechanism is mounted on the first crossbar above the path of travel of the container blank and includes means for bending a wire section into a loop when the crossbar is in its lowered position. This means is located above the path of travel of the container blank for movement with the remainder of the wire manipulating mechanism, so that it can form a "negative" loop over the container blank. The wire manipulating mechanism further includes a prong forming and driving device, similar to that shown in U.S. Pat. No. 3,702,146, but which is operated upon downward movement of the second crossbar to drive the prong into the container blank material. This prong forming and driving apparatus has a modified latching arrangement and cooperating loop stripping mechanism which provides a smooth and reliable operation.

The above, and other objects, features and advantages of this invention, will be apparent in the following detailed description of an illustrative embodiment thereof, which is to be read in connection with the accompanying drawings, wherein.

Figure 1:
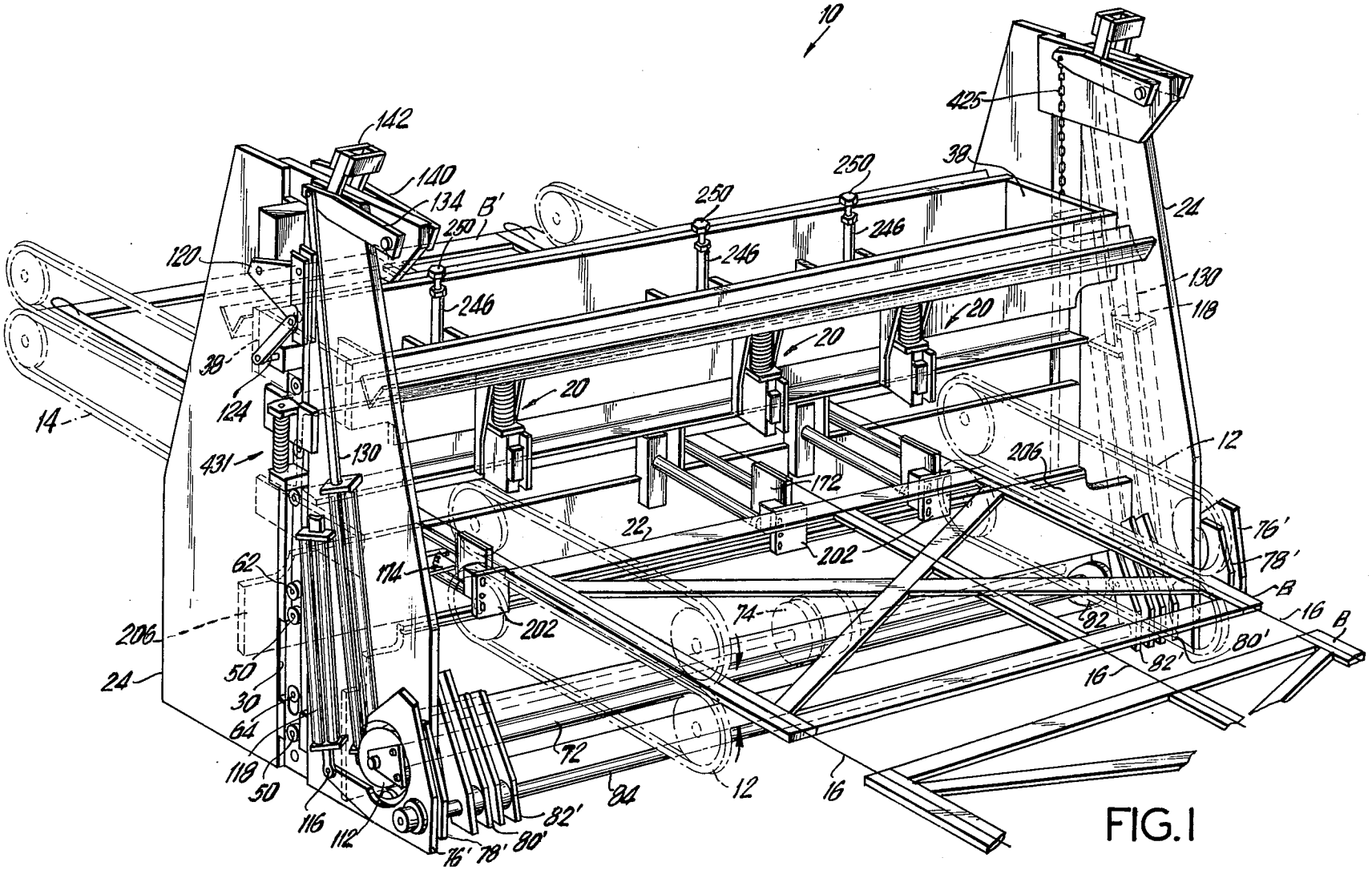
FIG. 1 is a partly schematic perspective view of a loop forming and driving apparatus constructed in accordance with one embodiment of the present invention.

Referring now to the drawing in detail, and initially to FIG. 1 thereof, a wire manipulating and loop forming apparatus 10 is illustrated which receives a continuous succession of wirebound container blanks B from a stapling machine. The blanks are fed to pairs of vertically arranged inlet conveyors 12 which grip the edges of the successive blanks therebetween and move the blanks into and through apparatus 10 to outlet conveyors 14. As illustrated in the drawing, blanks B are interconnected by binding wires 16.

As described hereinafter, when the succession of blanks reaches a predetermined position within apparatus 10, at which the binding wires 16 in the interval between adjacent blanks, are properly positioned, movement of the blanks is momentarily stopped and the apparatus is automatically actuated to cause wire cutting means in the apparatus to sever the binding wires 16. Then the wire manipulating mechanisms 20, mounted in the apparatus in association with each of the wires 16, are actuated to manipulate the cut binding wires. The wire manipulating mechanism 20 are located on both sides of the machine so that both ends of the cut wires, i.e., the ends on the leading edge 22 of the incoming blank B and on the trailing edge of the outgoing blanak B′, are simultaneously manipulated.

The manipulating mechanisms 20 include vertically positioned spindles located above the path of travel of the wirebound blanks through the apparatus, which spindles are rotated to bend the wires and form the loops therein while simultaneously positioning the cut end portions of the wires over the adjacent edges of the face material of blanks B, on top of hook-like extensions on loop bars in the loop forming and driving mechanism described hereinafter. After the wire ends are properly positioned, the loop forming and driving mechanisms form prongs in the wire ends and drive them through the face material of the wirebound blanks. Clinchers, located below the path of travel of the wirebound blanks are then actuated to clinch the prongs over against the undersurface of the blank material. After the clinching operation the wire manipulating mechanisms are moved vertically away from the wirebound blanks and the conveyors 12, 14 are actuated to move the blanks out of the machine.

Figure 3:
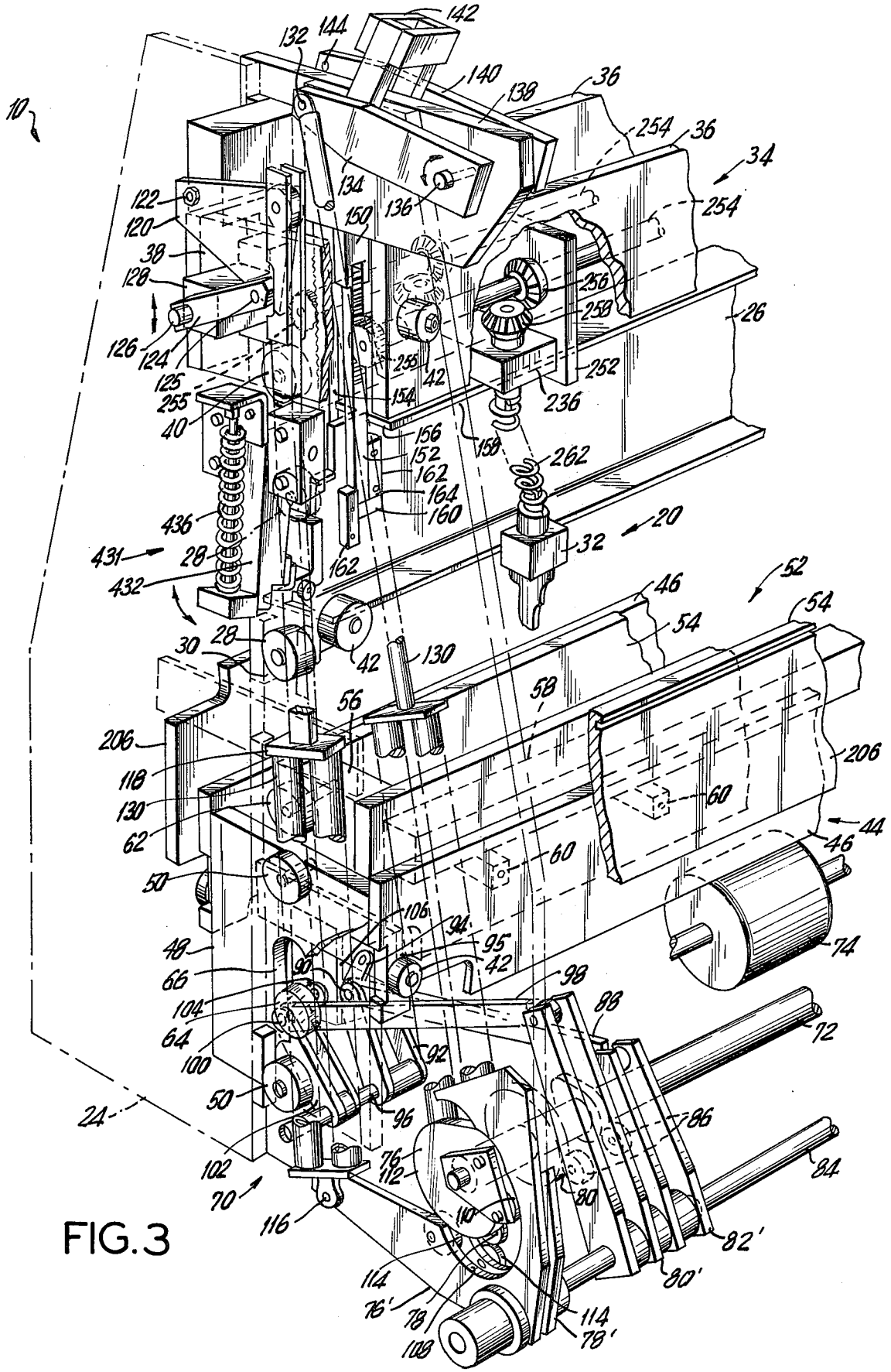
FIG. 3 is an enlarged perspective view of one end of the apparatus shown in FIG. 1 illustrating the drive arrangement for the wire manipulating mechanism.

Apparatus 10 includes a frame 24 in which four transversely extending cross beams or bars are mounted for vertical reciprocal movement to control operation of the cutting mechanism, wire manipulating mechanism, and clincher mechanism. As seen in FIG. 3, one of these cross bars consists of an I beam 26 having rollers 28 rotatably mounted at its end in a vertical slot 30 formed in frame 24. (It is noted, that although FIG. 3 illustrates only the left hand end of the apparatus, the structure shown therein is duplicated at the right hand portion of the apparatus, except as otherwise noted hereinafter.) The I beam 26 carries the wire manipulating mechanisms 20 (one of which is illustrated schematically in FIG. 3, with only the spindle portion 32 thereof shown) and is driven to raise and lower the wire manipulating mechanisms with respect to the blanks passing through the apparatus. When the blanks B are stopped in their proper position, the I beam 26 is lowered to properly position the wire manipulating mechanism with respect to the container blank and wire thereon.

A second crossbar or bear 34 is vertically reciprocally mounted in apparatus 10 above the path of travel of the container blank material through the machine. The crossbar 34 consists essentially of an elongated box-like structure having two beam sections 36 interconnected at their ends by cross plates 38. Beam sections 36 operate the prong forming and driving means of wire manipulating mechanisms 20, upon downward movement of bar 34. End plates 38 carry rollers 40 thereon which are received in the vertical slots 30 to guide vertical reciprocal movement of bar 34. It is noted that both bar 26 and bar 34 (and the other crossbars described hereinafter) can be provided with transverse rollers 42 thereon which engage the inner surface of frame 24 to aid in guiding movement of the bars.

Two other driving crossbeams are located in the apparatus below the path of travel of the container blank material. One of these bars, 44, consists of an elongated box-like beam having two transverse beam sections 46 extending between opposite ends of frame 24, which beam sections are connected by end plates 48. Bar 44 is vertically movably mounted in frame 24 by a pair of rollers 50 which are also located in the vertical slot 30 of frame 24. Beam sections 46 are used to operate the prong clincher mechanism, as described hereinafter.

Finally, the other lower crossbar, 52, in the apparatus is also a box-like structure which has beam sections 54 extending transversely of the path of travel of the container blank, which beam sections are connected by end plates 56. This bar carries, between beam sections 54, a cutter operating bar 58 which is supported on bar elements 60 extending between beam sections 54. Vertical reciprocal movement of this beam causes bar 58 to engage and operate the wire cutter mechanism on its upward stroke. The end plates 56 of bar 52 have rollers 62, 64 mounted thereon with the bottom roller 64 being mounted on an extension of end plate 56 and received in a vertical slot 66 in plate 48. The upper roller 62 is received in the slot 30 of frame 24.

The various crossbars are supported in frame 24 and driven in vertical reciprocation through a cam operated linkage mechanism 70 which includes a cam shaft 72 driven, as described hereinafter, by a motor 74 and on which four cam elements 76, 78, 80 and 82 are mounted. Cam elements 76 and 78 are located on the exterior of frame 24 while the two cam elements 80, 82 are located interiorly thereof. These cam elements are respectively associated with cam followers 76', 78', 80' and 82' for driving the respective crossbars. All of the cam followers are pivotably mounted, in any convenient manner, for independent movement on a transverse shaft 84 mounted in frame 24.

Cams 80 and 82 respectively control reciprocation of cutter crossbar 52 and clincher bar 44. Since these bars require a simple up-down motion during the operation of the apparatus, cam members 80, 82 have a simple construction with single enlarged lobes formed on their peripheral cam surfaces which engage follower rollers 86 on their associated cam followers.

Cam follower 82 is pivotally connected to a link 88 which, in turn, is connected at its opposite end 90 to a pair of control links 92, 94. Link 92 is pivotally mounted on a shaft 96 supported in frame 24, while link 94 is pivotally connected to a cross plate 95 extending between beam sections 46 of clincher bar 44. Links 92, 94 are normally positioned at an angle to each other to form a V, with link 88 pivotally connected thereto at the apex of the V. Cam 82 is designed such that rotation thereof will sequentially cause the V linkage to straighten and collapse. Accordingly when the V linkage straightens, bar 44 will be moved to its uppermost position and, when the linkage is collapsed to its innermost V configuration, bar 44 will be in its lowermost position. It is also apparent that by the location of cam follower 82' with respect to cam 82 the bar is vertically supported in the frame by links 92, 94. As mentioned above, and as seen in FIG. 1, this drive mechanism is duplicated on the right side of the machine for simultaneously driving the opposite end of the clincher crossbar.

Cam follower 80' is connected to a control linkage for cutter crossbar 52, which linkage is substantially identical to the control linkage for the clincher crossbar. That is, cam follower 80' is pivotally connected to a link 98 which is in turn pivotally connected at the apex 100 of a pair of angularly arranged links 102, 104. Link 102 is pivotally mounted on shaft 96, while link 104 is pivotally connected to a vertical extension 106 of the end plate 56 which extends between cutter beam sections 54. In this manner the V-shaped linkage defined by links 102, 104 will cause the cutter bar to reciprocate vertically as the linkage is straightened and collapsed under the influence of the cam follower 80'. Again, it will be apparent that the weight of the cutter bar is vertically supported on shaft 96 through linkage 102, 104 because of the location of the cam follower 80' with respect to cam 80. The downward bias of the weight of the beams on the linkage of course will maintain the cam followers in engagement with their associated cams.

Cam followers 76', 78', are respectively used to control vertical reciprocation of the crossbars 26, 34. In the course of operation of the apparatus these bars must move downwardly and remain in their down position for a predetermined period of time while the wire manipulations take place. Thus the cams for driving these crossbars are somewhat more complex than the cams for the cutter and clincher bars in order to control the stop-start motion and timing for these bars.

As seen in FIG. 3, cam follower 76 has an internal cam surface 108 of predetermined configuration for cooperation with a roller 110 rotatably mounted on cam 76. The latter, on the other hand, has a predetermined external cam surface configuration 112 which cooperates, selectively, with a roller 114 on cam follower 76'. Cam 78 and cam follower 78' have a similar arrangement, although their respective cam surface configurations are somewhat different.

Cam follower 76' is pivotally connected at 116 to an elongated link 118 which extends along the exterior of frame 24 to the top of the frame. At its upper end link 118 is pivotally connected at 121 to a plate type link 120 which is pivotally mounted at a fixed point 122 on frame 24. Link 120 forms, with a second link 124, a V-shaped linkage similar to those previously described, with link 124 being pivotally connected at 126 to an extension 128 on the end plate 38 of cross bar 34 and at 125 to plate 120. Link 118 is structurally of conventional construction and contains a telescopic spring shock absorber mechanism 130 in a pair of tubes (see FIG. 3) which form a part thereof.

In operation, when crossbar 34 is lowered, the cam surface 112 of cam 76 is engaged with roller 114 to urge cam follower 76' in a counterclockwise direction in FIG. 3, thereby moving the pivot points 121, 125 downwardly, to straighten the V linkage 120, 124 and lower crossbar 34. To raise the cross bar, the roller 110 comes into engagement with cam surface 108 of follower 76', to rotate the follower in a clockwise direction raising pivot points 121, 125 to return the V linkage 120, 124 to its original position. When bar 34 is to be stationary in its upper or lower positions, the flat surface portions of the cam surfaces 112, engage against rollers 114, whereby the beam is supported in its upper or lower position through the linkage 120, 124 while it is held in its stationary upper or lower position.

Cam follower 78' is connected through a link 130 which is substantially identical to link 118 previously described, with link 130 being pivotally connected at its upper end 132 to a lever 134. The latter is pivotally mounted on a pin 136 supported in an extension plate 138 on frame 24. A similar lever 140 is mounted on pivot pin 136, on the interior of frame 24, with the two levers 134, 140 being rigidly connected to each other by a bridge structure 142. In this manner, oscillating motion of lever 134 is transmitted directly to lever 140 on the interior of the frame.

Lever 140 is pivotally connected at its outer end 144 to a vertically extending link or pitman 146. The latter is pivotally connected at 148 (see FIG. 4) to a vertical support bar 150. Bar 150 is bifurcated and has two sections, 152, 154 (see FIG. 3), which extend downwardly past a notch 156 in the top flange 158 of beam 26, on opposite sides of the central web of the beam. Each of these vertical support bar sections has a bottom foot 160 rigidly secured thereto, with the support bars extending between a pair of spaced and offset guide bars 162 that are rigidly secured to the web of the I beam. As seen in FIG. 3, foot 160 of support bar 150 engages the bottom portion 164 of one of the guide bars 162 to vertically support the beam through the drive linkage. (The structure and arrangement is duplicated on the opposite side of the beam shown in FIG. 3). Accordingly, upon reciprocation of lever 134 under the influence of the cam and cam follower arrangement 78, 78', the I beam 26 will be raised and lowered. In addition, because of the slidable relationship of the vertical support bars 150 to the I beam 26, (between guide bars 162) the bars 150, when the I beam is in its lower most position, can move downwardly with respect to the I beam in order to operate a portion of the wire maniuplating mechanism, as described hereinafter. For this purpose, the exterior face of the vertical support beams are formed as elongated gearrack members, which are engaged with spur gears 255 to drive spindle drive shafts 254.

Figure 2:
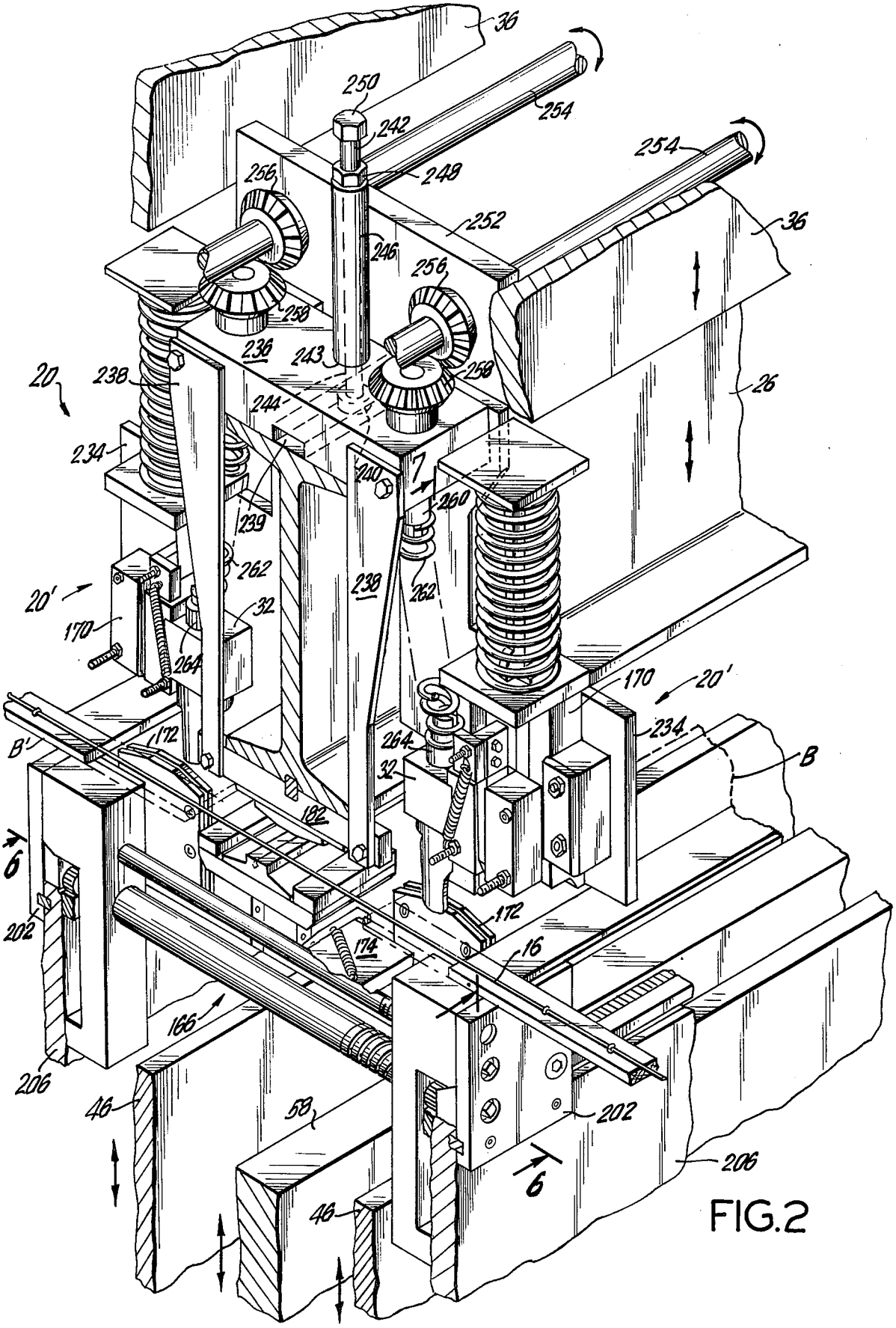
FIG. 2 is an enlarged perspective view of the wire manipulating mechanism used in the apparatus of the present invention.

Referring now to FIG. 2 of the drawing one of the wire manipulating mechanisms 20 is illustrated in greater detail. As mentioned, one of these mechanisms is arranged in frame 24 on I beam 26 in association with each of the binding wires passing through the apparatus. (Thus, as shown in FIG. 1 where the blank B has three wires, three of these manipulating mechanisms are mounted on beam 26). The wire manipulating mechanisms are individually adjustably mounted on I beam 26 in order to allow the relative positions of these mechanisms to be varied in accordance with the type and dimension of wirebound blanks being processed. Each of these mechanisms contain two wire manipulating units 20' on opposite sides of the I beam 26, with a common cutter arrangement 166 located therebetween. As described hereinafter, the common cutter arrangement 166 serves to sever binding wire 16 between the leading and trailing edges of two adjacent wirebound blanks B, B'. The cut wire is then engaged by spindle elements 32 of the respective wire manipulating units 20', which spindle elements are then rotated to bend the wire about a mandrel 168 mounted in their respective wire manipulating units. The free end of the looped or bent wire is then formed as a prong and driven into the face material of the wirebound blank by a former and driver mechanism 170 which is operated by the downward movement of cross bar 34. The portion of the prong which is driven through the face material is then clinched back into the bottom of the face material by a clincher mechanism 172 which is operated by upward movement of the clincher bar sections 46.

In order to properly position or stop the wirebound blanks in the desired alignment with cutter arrangement 166 and wire manipuating units 20', the apparatus is provided with a switch control member 174 (see FIGS. 2 and 15) that is used to control the drive mechanisms for the apparatus and for conveyors 12, 14. The switch is mounted adjacent the lower portion of cutter arrangement 166, as described hereinafter, in position to engage the leading edge 22' of an incoming wirebound blank B. It includes an operating button 175 which is depressed by a lever 176 having a free end 178 located in the path of travel of the leading edge 22 of the wirebound blank B. The lever 176 is normally biased towards button 175 by a spring 180.

During operation of the device, after a wire manipulating and driving operation, conveyors 12, 14 are operated to move the wirebound blanks through the apparatus. As the blanks are moving, the side edge of the blank B holds lever 176 in the extreme pivoted positions thereof, illustrated in phantom lines in FIG. 15, out of engagement with control button 175. When the trailing edge of a wirebound blank passes lever 176, the lever is freed to return to its solid line position because of the space between successive blanks. In this position the lever operates the switch 174 to prepare the apparatus to stop movement of the blanks. When the leading edge 22 of the next blank B approaches the switch, it engages lever 176 and moves it towards the intermediate dotted line position shown in FIG. 15. This movement of lever 176 causes switch 174 to stop the drive to conveyors 12, 14 so that the blanks are stopped in proper alignment with cutter arrangement 166 and wire manipulating units 20'.

Figure 6:
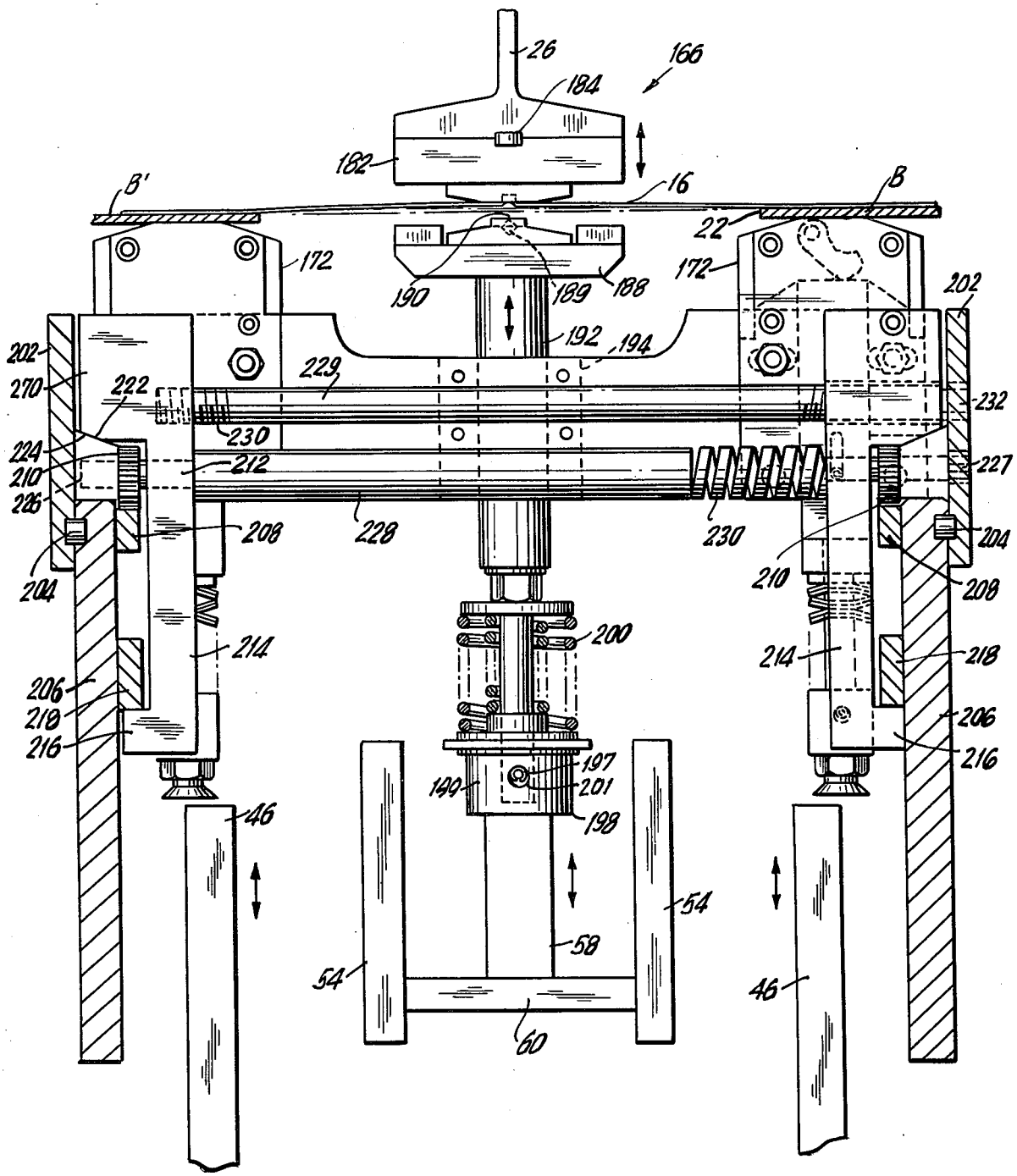
FIG. 6 is an enlarged elevational view taken along line 6—6 of FIG. 2, showing the mounting arrangement for the cutter mechanism and wire clinching means used in the apparatus of the invention.

Cutter arrangement 166 and the mounting structure therefore are more clearly illustrated in FIG. 6. As seen therein, I beam 26 has a bottom plate 182 slidably mounted thereon, by a key 184, and in which a flat carbide steel block 186 is removably mounted. This block moves with I beam 26 in its vertical reciprocation. When I beam 26 is lowered, at the initiation of a wire manipulating operation, as described hereinafter, block 186 is placed adajcent the upper surface of the binding wire 16 interconnecting two wirebound container blanks B, B'.

Figure 6A:
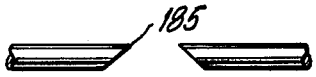

A lower cutter block 188 has a carbide bar 189 removably mounted therein with an edge 190 thereof directed upwardly and transversely to the path of travel of wire 16 through the apparatus. Block 188 includes an elongated step 192 which is slidably mounted in a bearing collar or the like 194 secured to a support block 196. After I beam 26 has dropped to its lower position, cam follower 80' operates cross bar 52 to raise cutter operating bar 58 into engagement with the lower end 198 of rod 192 to raise cutter block 188 towards wire 16. This upward movement causes the carbide blocks 186, 189 to cooperate and sever wire 16 in a transverse cut, as illustrated in FIG. 6A. As a result, the wire is cut with a sharp edge 185 which tapers towards the upper wide of the wire and is generally horizontal. It is noted that upward movement of lower block 188 against the bottom of I beam 26 may tend to lift the I beam from its lowermost position. For this reason, a latch arrangement, as described hereinafter, is provided at both ends of the apparatus for locking the I beam in its down position during the cutting operation.

In order to protect the cutter mechanism against damage should a screw or other foreign object become caught between blanks 182, 188, the lower end 198 of bar 192 is slidably mounted in a cap 199 and secured thereto by a pin 197 received in enlarged recesses 201 formed in the cap. A spring 200 biases the cap 199 downwardly so that the rod's pin 197 engages the upper end of recesses 201. Thus if something caught between blocks 182, 188 prevents upward movement of block 188, the upward drive of bar 58 is accommodated in the lost motion connection formed by pin 197 and recess 201.

Support bar 196 is rigidly secured, by bolts or the like, to a pair of end plates 202 which are keyed by blocks 204 in key ways on support bars 206 to allow sliding movement therealong. Bars 206 are fixed rigid members which extend between the opposite ends of frame 24 (see FIG. 1) transversely of the path of travel of the wirebound blank. Thus the position of support bar 196 can be varied across the apparatus for accurate alignment of the upper and lower cutter blocks and the other wire manipulating devices in the apparatus.

To permit accurate adjustment of the position of support bars 196, support members 206 are provided with elongated gear racks 208 on their inner surfaces. These gear racks cooperate with spur gears 210 mounted on the ends of a shaft 212. The latter is rotatably mounted in clampling plates 214 which, as illustrated in FIG. 6, includes lower legs 216 (engaging against the bottom sides of bars 218, rigidly secured to support members 206) and upper extensions 220. The latter have inclined surfaces 222 which engage complementary inclined surfaces 224 on auxiliary bars 226 secured to end plates 202 in any convenient manner. One end 227 of shaft 212 extends through the right end plate 202 (in FIG. 6) and has a square head that can be engaged by a socket wrench or the like to allow manual rotation thereof. In this manner, gears 210 can be rotated to move the entire assembly along support bars 206. It is noted that preferably shaft 212 is surrounded by a sleeve 228 and a spring 230 at one end thereof, which spring biases clamping plates 214 apart and into engagement with the inclined surfaces 224 of bars 226.

In order to lock the support bar 196 in position where desired, an additional shaft 229 is provided which has oppositely handed threads 230 at opposite ends thereof threadably engaged in the clamping bars 214. One end 232 of shaft 229 extends through the right plate 202 and also has a square head for engagement by a socket wrench or the like. By rotating shaft 229 in the proper direction, the oppositely threaded ends thereof will drive clamping plates 214 apart, into engagement with the inclined surfaces 224. By moving these clamping plates apart, the upper extensions 220 thereof will tend to move upwardly on the inclined surfaces 224, causing the lower extensions 216 to tightly engage against bottom bars 218, and thus tightly clamp the assembly in place.

Support bar 196 also carries thereon the clinching mechanism 172 for each of the wire manipulating units 20'. These mechanisms, as described more particularly hereinafter, are operated upon the upward movement of clincher bar sections 46. In addition, the switch 174 can be mounted in any convenient manner on the leftmost support bar 196 in the apparatus, as shown in FIG. 1.

Figure 7:
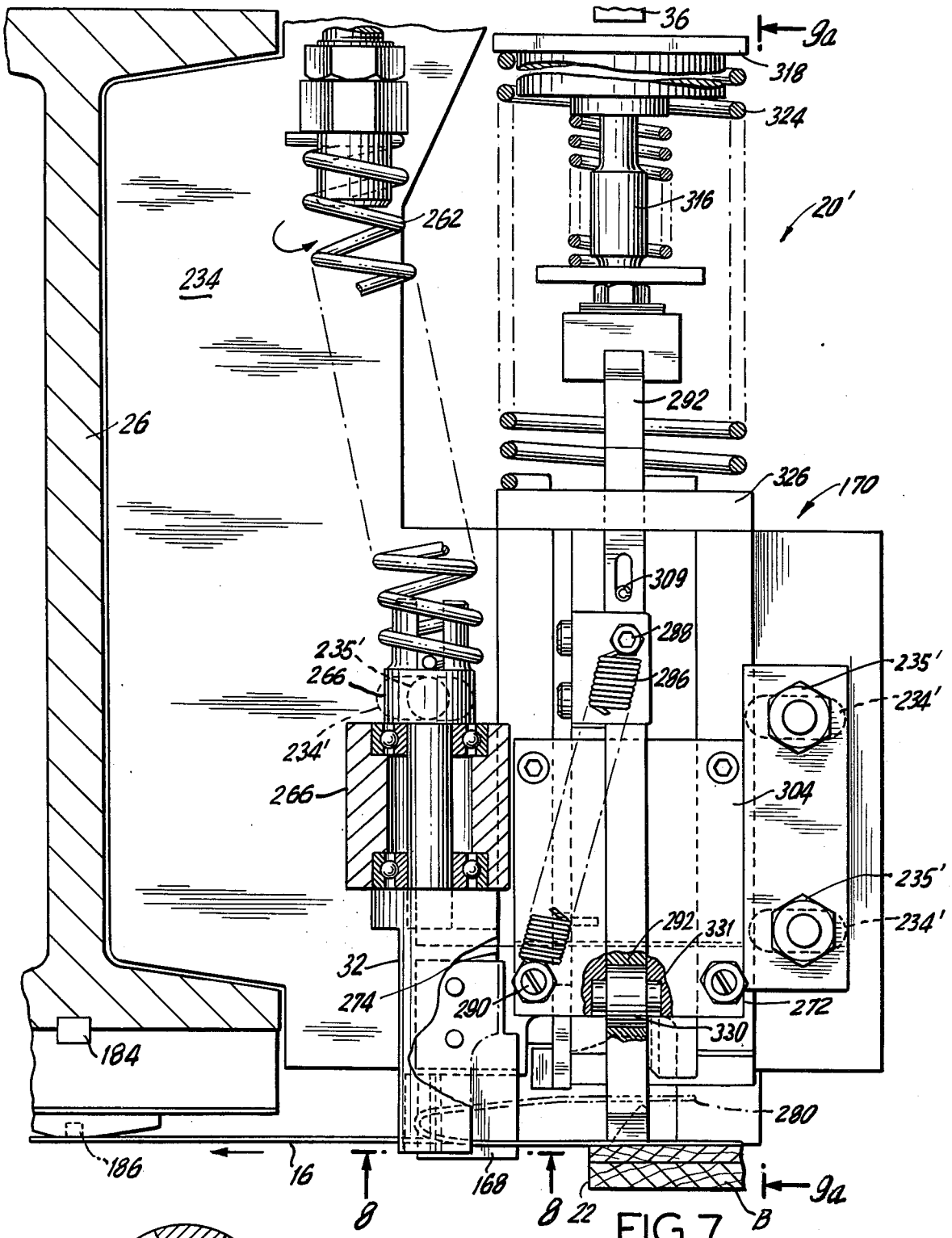
FIG. 7 is an enlarged elevational view, taken along line 7—7 of FIG. 2, showing the wire manipulating mechanism.

The upper sections of the wire manipulating units 20 are mounted on support plates 234 (FIGS. 2 and 7) which are secured to upper and lower support blocks 236 and 182, in any convenient manner, as for example by bolts or the like, on opposite sides of these blocks from support straps 238. As mentioned, the lower support block 182 is keyed to the bottom side of I beam 26, thereby to allow relative sliding movement of the entire wire manipulating unit longitudinally along the length of the I beam. Upper block 236 on the other hand has a groove 239 formed therein which receives a bearing member 240. A threaded rod 242 is positioned to extend through a threaded vertical aperture 243 in block 236, with its lower end 244 in engagement with bearing 240. A collar 246 surrounds rod 244, with a threaded nut 248 being positioned on the shaft between the collar and rod head 250. By this arrangment, upon rotation of the rod 242, in a direction to move the rod inwardly of block 236, a tight clamping effect is produced on I beam 26 between the plate 182 and rod 242, thereby to securely lock the wire manipulating units in a fixed position. By loosening the rod or bolt 242, the entire assembly can be slidably adjusted along the length of the I beam.

The upper end of I beam 26 also carries a plurality of shaft support plates 252, secured to plates 236 for movement therewith, in which spindle shafts 254 are rotatably and slidably mounted in any convenient manner. These shafts, as described hereinafter, are rotated when support bar 150, carrying the I beam, is moved downwardly after downward movement of the I beam has stopped. Rotation of these shafts causes rotation of spindles 32 in order to bend the previously cut binding wire 16 and form a loop therein.

Rotation of shafts 254 is transmitted through beveled gears 256, which are slidably mounted on the shafts (but which can be secured firmly to the shafts in any desired position) to complementary bevel gears 248 rotatably mounted in upper support blocks 236. These bevel gears include integral shaft extensions 260 to which a relatively strong elongated coil spring 262 is secured. The lower end 264 of spring 262 is secured to a shaft extension 266 for spindle 32. The latter is rotatably mounted in a bearing housing 266 carried by support plate 234. The spring 262 forms a universal joint connection between shaft extensions 260 and 266 to accommodate lateral adjustment of spindle 32 on plate 234 as described hereinafter and transmit rotation therebetween, whereby rotation of gears 258 will cause rotation of the spindle.

Figure 5:
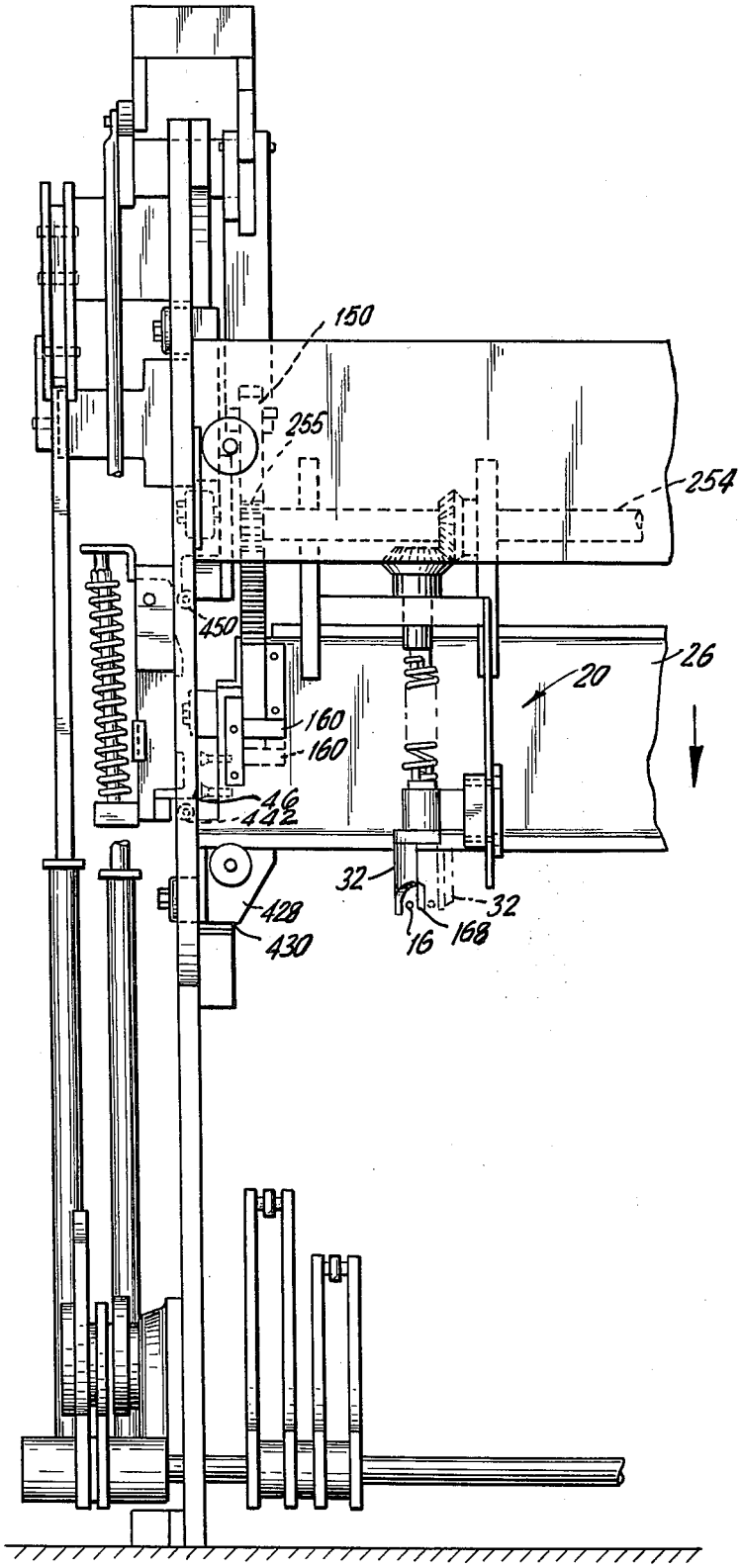
FIG. 5 is an elevational view, similar to FIG. 4, but showing the configuration of the drive mechanism after an initial step of the drive sequence has occurred.
Figure 5A:
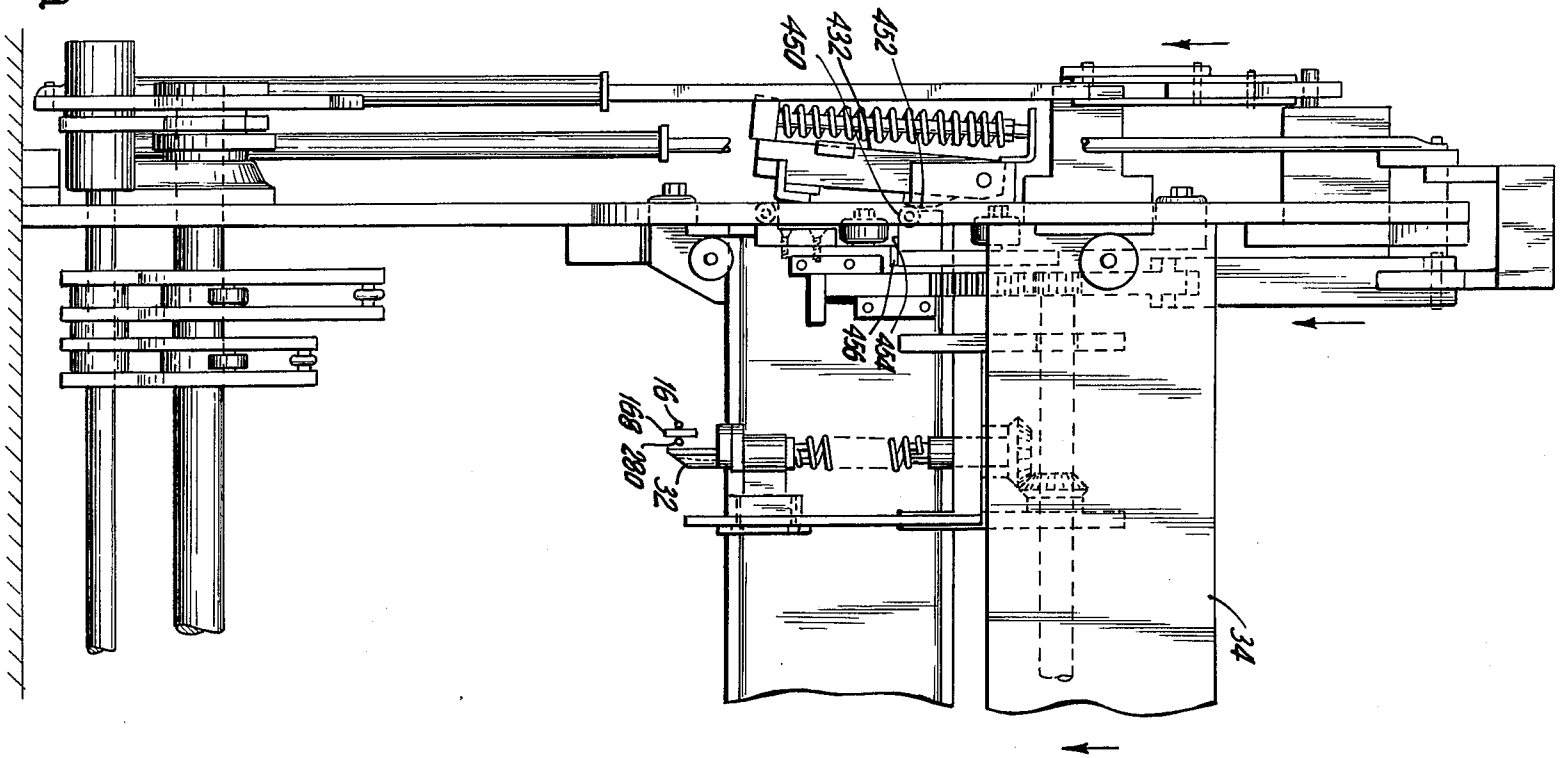
FIG. 5A is an elevational view, similar to FIG. 5, but showing the configuration of the drive mechanism after the next operating step in the apparatus.
Figure 8:
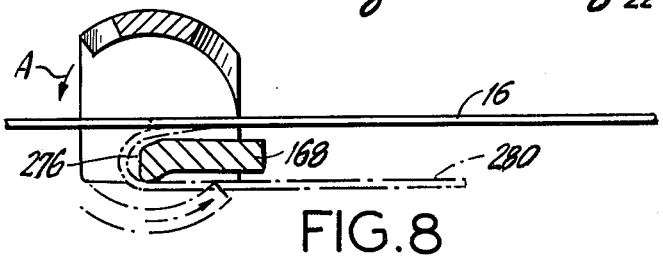
FIG. 8 is a bottom view taken along line 8—8 in FIG. 7.

The former-driver units 170 are also carried by plates 234, and serve to form the prongs and drive them through a face material of the wirebound blank after the wire has been cut and bent into loops. The former drive units are of identical construction and each includes a housing 272 which carries, at the lower end thereof an extension plate 274 on which the relatively flat vertically extending mandrel 168 is mounted. The mandrel, as seen in FIG. 8, has a slightly curved or bent forward end 276 about which the binding wire 16 is bent by spindle 32. As seen most clearly in FIG. 8, the spindle has a partially cylindrical configuration and is located with respect to mandrel 168 such that when I beam 26 is dropped down to its lowermost position, the spindle will be on the opposite side of its associated binding wire 16 from its associated mandrel 168 (FIG. 5). Accordingly, the wire is captured between the curved spindle and the mandrel so that, after the wire is cut by cutter bars 186, 189 the spindle can be rotated in the direction of the arrow A in FIG. 8, to bend the binding wire about mandrel 168 (FIGS. 5 and 5*a*), thereby to form the desired loop in the free end 280 of the binding wire. It is noted that by modifying the configuration of the tip 276 of the mandrel, the dimension or width of the loop can be varied.

By this spindle arrangement, the end 280 of the binding wire is swung over the edge 22 of the face material forming the blank B. However, although in the illustrative embodiment of the invention the edge of the face material 22 is not below the spindle, with the result that a "positive" loop is formed, the present invention is adapted to form a "negative" loop, even if the edge of the face material extends beyond spindle 32. That is, if movement of the blank B is stopped so that the face material is located below the spindle, the face material will not interfere with the engagement and bending of the binding wire by the spindle, so that a "negative" loop can be formed (see FIG. 13b). To this end the bearing 266 for spindle 32 and housing 272 of the former driver units 170 are mounted together on plate 234 for simultaneous adjustment laterally with respect to cutter bar 188. That is, plate 234 has horizontal slots 234' formed therein and a clamping plate 235 is located adjacent plate 234, on the side thereof opposite housing 272. Bolts 235' extend through slots 234' in plate 234 and are threadably engaged with bearing 266 and housing 272 to clamp them on plate 234. By loosening bolts 235', the spindle and former driver can be laterally adjusted on plate 234 to the extent of slots 234'.

Figure 9A:
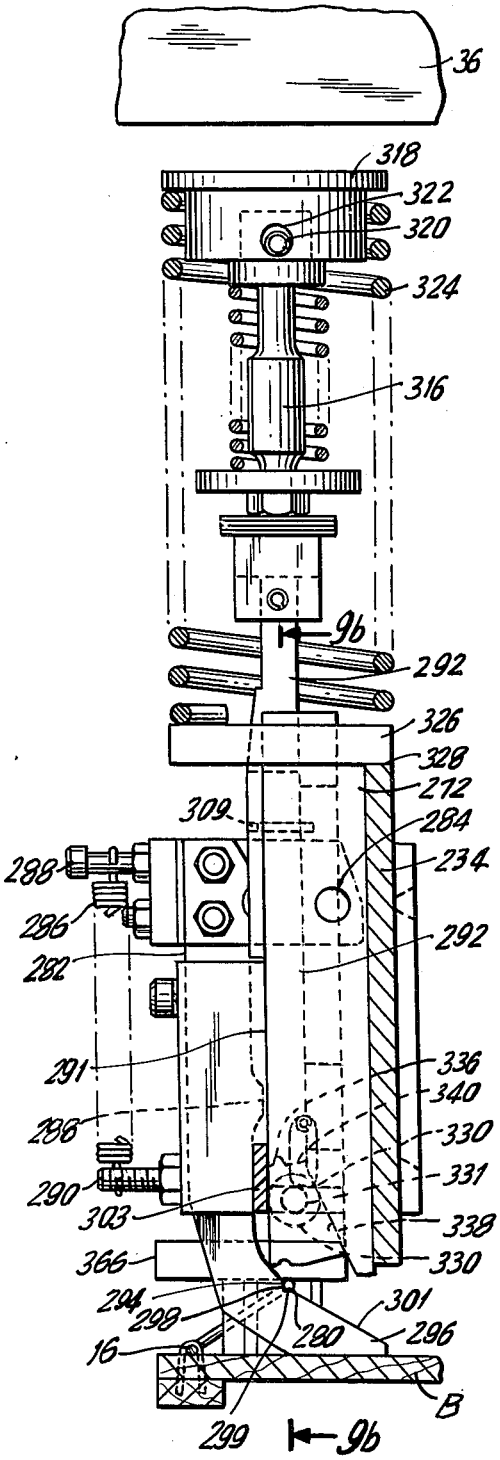
FIG. 9A is a side elevational view taken along line 9A—9A in FIG. 7, showing the configuration of the prong forming and driving mechanism prior to the formation and driving of the wire prong in the wire loop.

As best seen in FIG. 9A, a loop bar 282 is pivotally mounted at 284 in housing 272 and is urged to swing in a counterclockwise direction (as viewed in FIG. 9A) by a spring 286 which extends from a pin 288 at the upper end of the loop bar to a bolt or other connecting member 290 on housing 272. The counterclockwise movement of the loop bar is limited by engagement of a stop or extension portion 288 thereof against the left edge 291 of a driver bar 292 supported in housing 272 in the same vertical plane as that occupied by the loop bar.

The end portion 280 of the binding wire, when bent by spindle 32, is swung over the face material to a point where the wire engages the inner edge 294 of loop bar 282. The latter is provided at its lower end with a hook-like extension 296 that projects laterally in the direction from which end 280 of binding wire 16 approaches. The upper edge 298 of the hook-like extension has a flat section 299 and then tapers downwardly and outwardly along an inclined surface 301. As the binding wire is bent by spindle 32 surface 301 cams the moving end 280 of the binding wire upwardly onto the horizontal flat section 299 of extension 296 thus the wire is properly positioned for the prong forming and driving operation.

Housing 272 is provided with a vertical slot 300 (FIG. 9b) in which a single former bar 302, of generally U-shaped cross section, is supported for vertical sliding movement. The former bar has two legs 304, 306 which define a vertical slot therebetween that slidably receives driver bar 292. The latter is held in the slot in the former bar by engagement with the upper end 308 of the loop bar, even when the loop bar is pivoted out of the way (see FIG. 11), and by a cross bar 303 formed in housing 272. Driver bar 292 is permitted to slide vertically with respect to the former bar over a limited range of movement, by means of a pin and slot arrangement wherein a pin 309, mounted in the bight portion 310 of former bar 302 (between legs 304, 306) extends into a vertically elongated slot 312 in the driver bar. In the initial position of the former-driver apparatus, the pin 309 is located in the bottom of slot 312 so that the former bar is vertically supported by the driver bar.

The upper end 314 of driver bar 292 is pinned to the lower end of a shaft 316 which extends upwardly to a cap member 318 slidably supported on its upper end. Cap 318 is pinned to shaft 316 by a pin 320 which is secured in shaft 316 and extends through slightly enlarged bores 322 in the cap. The cap, and thus driver bar 292, is biased upwardly to an upper limit position (defined by structure to be described hereinafter) by a large spring 324 which extends between cap 318 and a base plate 326 which abuts against the upper end 328 of bracket 234. Cap 318 is located in position beneath cross bar sections 36, for operation thereby upon downward movement of these cross bar sections. Thus the driver bar 292 moves downwardly with cross bar 34, but returns upwardly upon upward movement of the cross bar, under the influence of spring 324.

Although the pin and slot arrangement 309, 312 allows relative vertical movement between the former and driver bars, the bars are effectively latched to one another for movement in unison during the initial downward movement of the driver bar. This latch arrangement consists of a roller 330, such as for example a metal sleeve rotatably mounted on a metal shaft 331, which is slidably and rotatably mounted in grooves 334 located in the legs 304, 306 of the former bar. These grooves extend transversely of the path of travel of the binding wire and receive the ends of shaft 331. In the up position of the driver bar, illustrated in FIGS. 9A and 9B, roller 330 is located below the lower end 336 of the driver bar, between legs 304, 306 of the former bar. The roller is biased into the position shown in FIG. 9A, wherein it is against the cross piece 303 of housing 272, by a cam surface 338 formed on the back of housing 272 and tapering downwardly and away from the driver bar. As seen in the drawings, cam surface 338 extends between the lower ends of legs 304, 306 of the former bar beneath the bight portion 310 thereof. In this position roller 330 blocks downward movement of the driver bar, so that a downward force applied to the driver bar cross bar section 36 will cause the driver and former to maintain their relative position and move downwardly in unison. As the former bar moves downwardly, it carries with it roller 330 which is progressively freed for lateral movement to the right, by the inclination of cam surface 338. To aid in this rightward movement, the lower end 336 of driver bar 292 includes a cam surface 340 which is inclined to urge the roller to the right (in FIG. 9A) against cam surface 338.

Figure 9B:
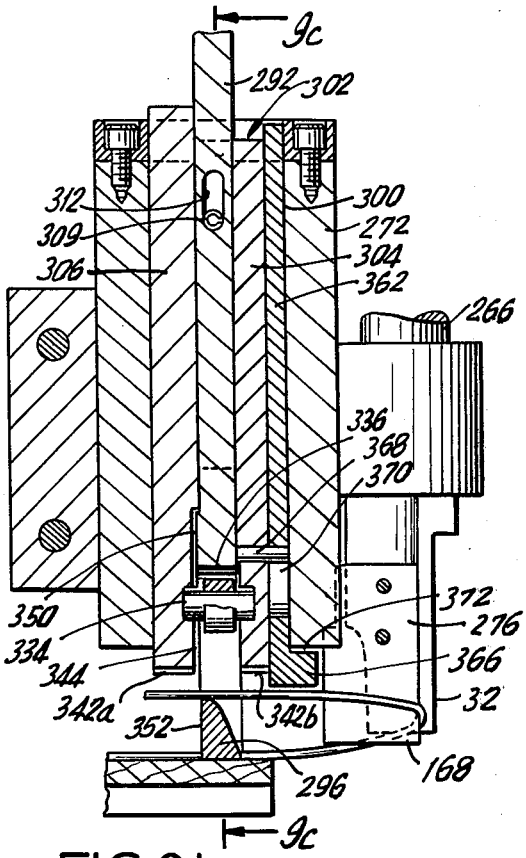
FIG. 9B is a sectional view taken along line 9B—9B in FIG. 9A.

With the former and driver bar located in the relative position shown in FIG. 9A by the roller 330 during the initial downward movement of the driver bar, the lower ends 342A and 342B of former bar legs 304, 306, are both spaced below the lower end 336 of the driver bar a distance slightly exceeding the length of the prong to be formed. Thus, as shown in FIGS. 9B and 9D, as the former bar descends, with the locked in driver bar, the lower end 342A of the leg 306 engages the portion of binding wire 16 which projects beyond hook-like extension 296 of loop bar 282 to bend the wire downwardly around the loop bar, and form a prong P (see FIG. 9D), which is snugly received within a vertical groove 344 in the inner face of leg 306 of the former bar. At the same time the lower end 342B of the leg 304 of the former bar depresses the adjacent horizontal portion of the binding wire to form a knuckle K adjoining the prong. The wire is guided into groove 344 by a funnel shaped surface on the lower end 342A of the leg 306.

Figure 10:
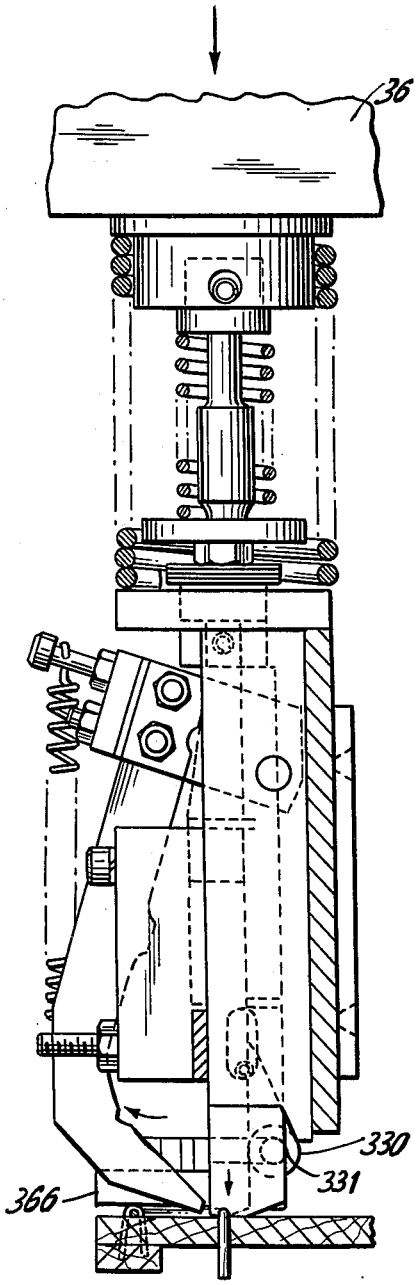
FIG. 10 is an elevational view, similar to FIG. 9A, but showing the configuration of the prong forming and driving mechanism upon completion of the driving step.
Figure 9C:
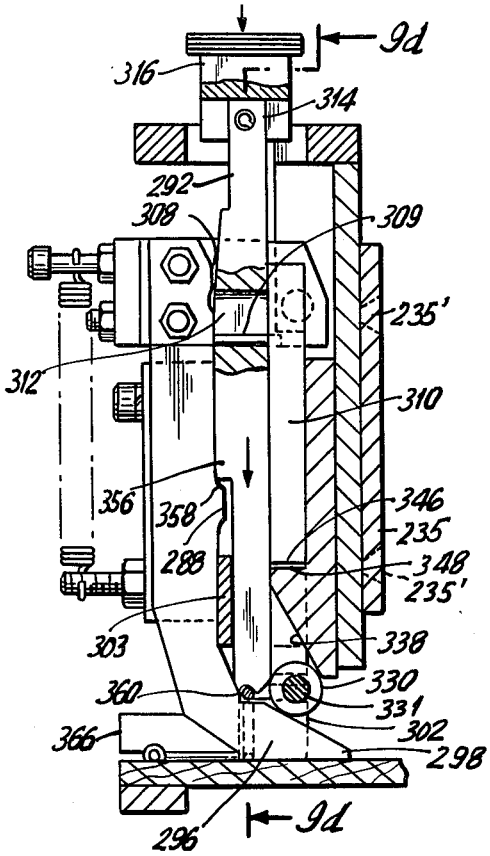
FIG. 9C is a sectional view taken along line 9C—9C in FIG. 9B, showing the configuration of the prong forming and driving mechanism after the prong has been formed, but before driving of the prong has commenced.
Figure 9D:
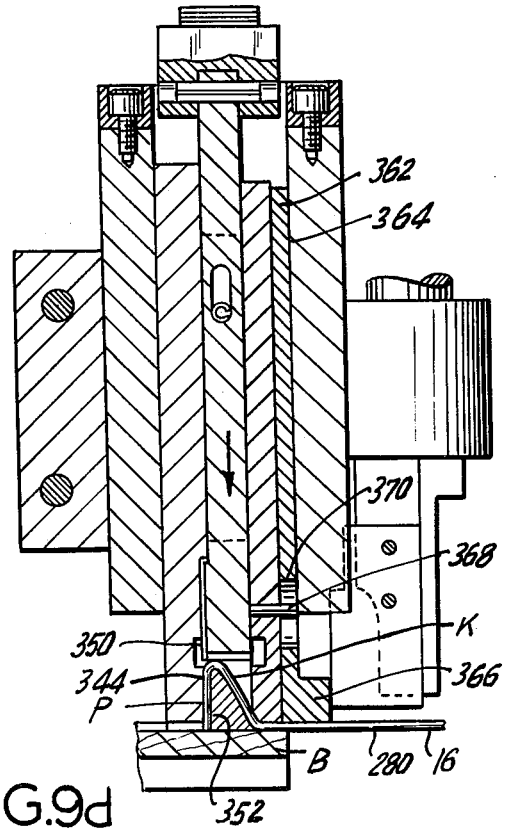
FIG. 9D is a sectional view taken along line 9B—9B in FIG. 9C.
Figure 11:
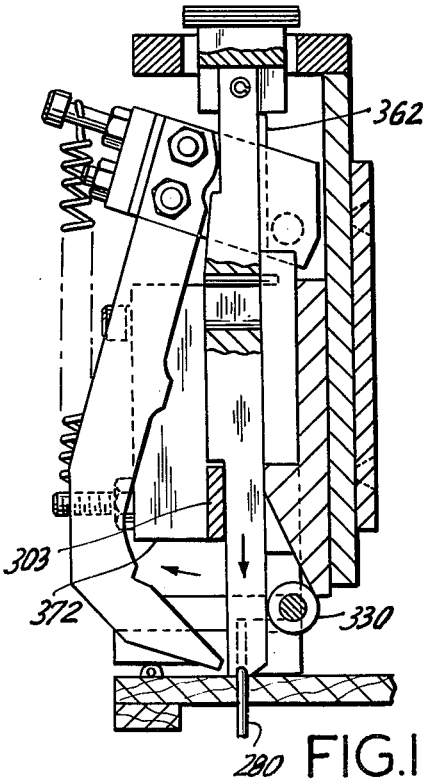
FIG. 11 is a sectional view, similar to FIG. 9C, of the prong forming and driving mechanism in the configuration illustrated in FIG. 10.

As the downward unitary movement of the former and driver bar approach the position shown in FIG. 9C and 9D, wherein the prong P has been formed, roller 330, due to the inclination of cam surface 338, has moved away from its latching position beneath the driver bar. At the same time further downward movement of the former bar is prevented by the engagement of the bottom end 346 of its bight portion 310 with the upper surface 348 of cam surface 338. Accordingly downward movement of the former is stopped but the driver bar 292 is freed to continue to move downwardly by itself. This further downward movement of the driver bar causes its lower end 336 to engage knuckle K and drive prong P through the face material of the container blank B, as shown in FIGS. 10 and 11. In this connection, the driver bar preferably includes extension segment 350 which is received in groove 344 on the inner face of former bar leg 306. This extension will engage knuckle K directly over prong P, so that the downward driving force of the driver bar is applied axially to the prong. As the prong is thus driven, it is supported on the inside by the outer face 352 of loop bar 296 and on its other three sides by the walls of groove 344 on the inner face of former bar leg 306. Accordingly the prong can neither buckle nor be deflected, and its proper penetration into and through the face material is assured.

When the driver bar reaches the position illustrated in FIG. 9C, cam surface portion 356 thereof engages an upper cam surface 358 of enlargement 288 on the inner face of the loop bar 282, in order to commence camming the loop bar out from beneath knuckle K, against the bias of spring 286. Further downward movement, after this initial camming action, causes the cam surface portion 360 at the lower end of driver bar 292 to engage the inclined portion 301 of hook-like projection 296, to continue moving the hook-like extension on the loop bar out of the path of the descending adjacent horizontal portion of the binding wire. The inclination of the upper surface 301 of the outer portion of hook-like extension 296 progressively reduces the effective height of the hook-like extension as it moves outwardly, in proportion to the reduction of the height of the exposed portion of prong P, so that the inside of the prong is continually supported substantially along its full exposed length until the prong has been fully driven into the face material. Once the prong is driven entirely through the face material, as illustrated in FIG. 11, it is bent back into the face material by the clincher mechanism, as described hereinafter.

Also mounted in the slot 300 in housing 272 is a stripper bar 362, located between leg 304 of the former bar and the side wall 364 of slot 300. The lower end of the stripper bar includes an elongated presser foot 366. The stripper bar is operatively connected to the former bar for relative movement therewith by means of a pin 368 secured to the leg 304 of the former bar and received within a slot 370 formed in the stripper bar. In the raised position of the former driver mechanism, pin 368 engages the upper end of slot 370 to support the stripper bar in the position shown in FIG. 9B wherein the lower surface of presser foot 366 extends slightly below the bottom edges 342A, 342B of the former bar. By this arrangement the presser foot, upon initial downward movement of the former and driver bars, engages the loop portion of the binding wire B with a relatively light, undriven force and does not materially affect bending of the wire into the prong P and knuckle K. However at the end of the prong driving stroke, i.e., as prong P is fully driven the driver assembly connection 316 engages the upper end of stripper bar 362 to drive it with a positive action towards the stroke and thus insure that the loop is stripped from mandrel 168 during upward movement of the wire manipulating mechanism. Thus, in the down position of the former bar, (before the driver bar is fully driven), the stripper bar takes the position illustrated in FIG. 9D, wherein the relationship of the pin 368 and slot 370 is such that the top edge of the slot 370 is spaced from pin 368 and presser foot 366 and the presser foot in effect "floats" on the loop 280. When the driver bar is fully driven, as seen in FIG. 11, the presser foot is driven against the stock by member 316 to hold the loop portion of the wire down against the blank material.

Upon completion of the driving operation, cross bars 36 are raised by the drive mechanism heretofore described, and the driver bar 292 follows the cross bar 34 upwardly under the influence of spring 324. Initially, because of the pin and slot arrangement 309, 312, the driver bar only will move upwardly, until its lower end 336 is again above the level of roller 330. At that position the lower end of slot 312 engages pin 309 and further upward movement of bar 292 causes the former bar to move upwardly with the driver. This upward movement of the former bar urges roller 330 against cam surface 338 which, in turn, causes the roller to move to the left (in FIG. 9C) towards the cross piece of the housing and into position below the driver bar.

When cross bar 34 commences its upward motion, I beam 26 is also moved upwardly, in order to raise the wire manipulating mechanism away from the wire-bound container blank, in order to free the path of travel for the blank through the apparatus. However, because of the lost motion connection between former bar 302 and stripper bar 362, the presser foot 366 will remain engaged with the binding wire loop for a short period of time as the I beam moves upwardly. This insures that the loop does not remain engaged with the mandrel 168, about which it had been bent, while the mandrel is moving upwardly with the I beam. Ultimately, the combined upward movement of the I beam and the upward movement of the former bar within the housing 272 will cause pin 368 to engage the top edge of slot 370, lifting the stripper bar with it.

Finally, upward movement of the presser foot causes it to engage a bottom edge 372 (FIG. 11) of housing 272 to limit further upward movement of the stripper bar, and thus former and driver bars, under the influence of spring 324. This is the configuration illustrated in FIG. 9B, except that the housing is raised above the container blank material in preparation for the next sequence of operation wherein I beam 26 is again moved downwardly to place the wire manipulating apparatus against the blank material in the configuration shown in FIGS. 7 and 9B.

As mentioned, the free end 280 of the binding wire is clinched or driven back into the face material after being driven through the face material by the former driver mechanism. The clinching mechanism 172 is illustrated in detail in FIG. 12, wherein it is seen that the clincher includes a housing 380 in which a clinching lever 382 is pivotally mounted on a pivot pin 384. The clinching lever includes an upper surface 386 which has a concave groove formed therein for receiving the extreme free end of the wire prong.

Housing 380 is mounted on the support bar 196, previously described, by means of a pair of bolts 388 extending through slots 390 in the support bar. This arrangement allows the lateral position of the clincher to be adjusted as necessary.

A clincher driving rod 390 is slidably mounted in housing 380 for vertical movement, limited by a slot 392 in the housing which receives a pin 394 mounted in the rod. The lower end of the rod is connected to a driving head 396 by a pin 398 received in an enlarged bore in the head. The head 396 is held downwardly in the position shown in FIG. 12 by a series of Belleville washers 400.

After prong P has been driven, clincher bar sections 46 are driven upwardly under the influence of cam follower 82' as previously described. This upward movement causes the upper end 402 of rod 390 to engage lever 382 and pivot the lever upwardly from the solid line position thereof shown in FIG. 12 to the dotted line position shown therein. This movement causes the free end 185 of prong P to be driven into the face material in a "Z" type clincher. It is noted that because of the manner in which the binding wire was cut by the cutting mechanism, i.e., by the transverse cut formed by the bars 186, 189 (see FIG. 6A), the extreme point 185 of the cut end is either driven into the face material (see FIG. 14A) or is flush with the face material so that it cannot hook on or tear an operator's clothing or skin. This is as opposed to previously proposed cutting mechanisms used in loop forming apparatus wherein the wire cuts are made from the side so that a vertical wire edge is always exposed in the clinched prong.

Figures 12, 12A, 13A, 13B, 14A, 14B:
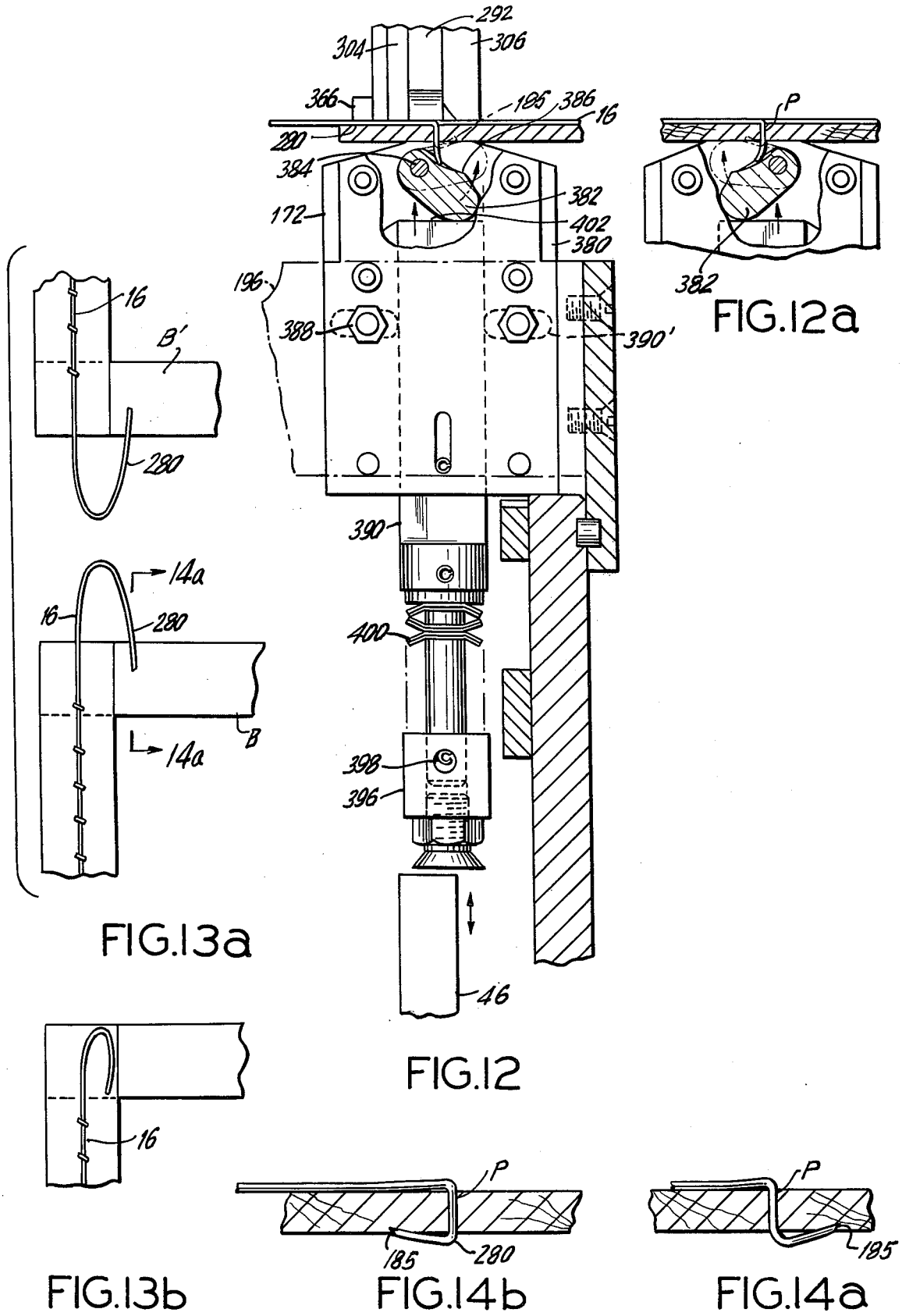
FIG. 12 is an enlarged elevational view, with parts broken away, of the prong clinching mechanism used in the apparatus of the present invention.
FIG. 12A is a partial elevational view, with parts broken away, similar to FIG. 12 and showing a modification of the clincher mechanism.
FIG. 13A is a plan view of the corners of adjacent wirebound blank sections having "positive" wire loops formed therein.
FIG. 13B is a plan view, of a corner of a wirebound blank section having a "negative" loop formed thereon.
FIG. 14A is a sectional view taken along lines 14A—14A in FIG. 13A showing the configuration of the driven and clinched wire prong at the end of a loop.
FIG. 14B is a sectional view, similar to FIG. 14A, showing the configuration of the clinched prong when clinched by the apparatus of FIG. 12A.

In another form of the invention, lever 382 of the clingher can be reversed, as illustrated in FIG. 12A. In this embodiment upward movement of the clincher bar 390 will cause prong P to be driven in the opposite direction to form a conventional loop-type clinch, as illustrated in FIG. 14B. Preferably where this type of clinch is formed, the cutters 186, 189 are reversed in their mounting so that the sharp edged cutter bar 189 is on the I-beam and the flat cutter bar is below the path of travel of the wire. In this manner the sharp edge 18, will be on the lower side of the wire (as opposed to the cut illustrated in FIG. 6A) so that the pointed edge 185 is driven into the face material as seen in FIG. 14B when the clincher of FIG. 12A is operated to form a loop clinch.

Figure 16:
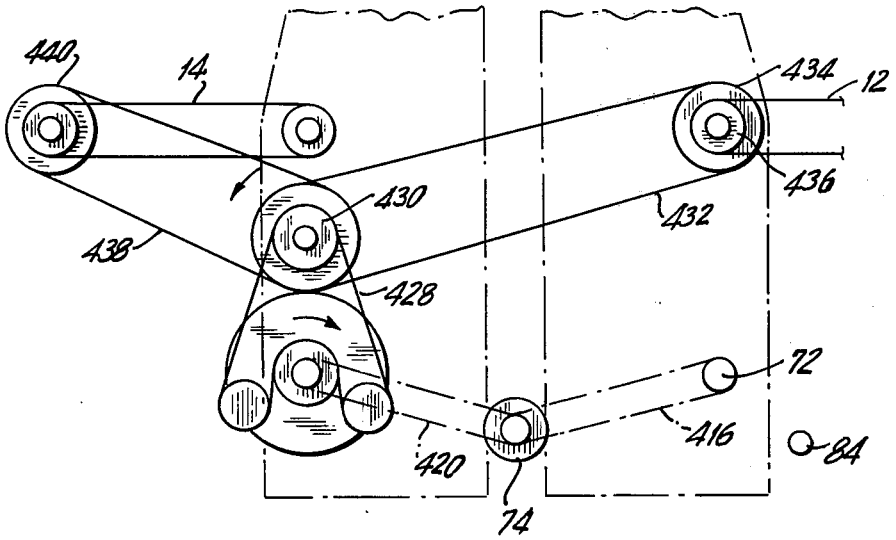
FIG. 16 is a schematic elevational view of the drive train for the apparatus.
Figure 17:
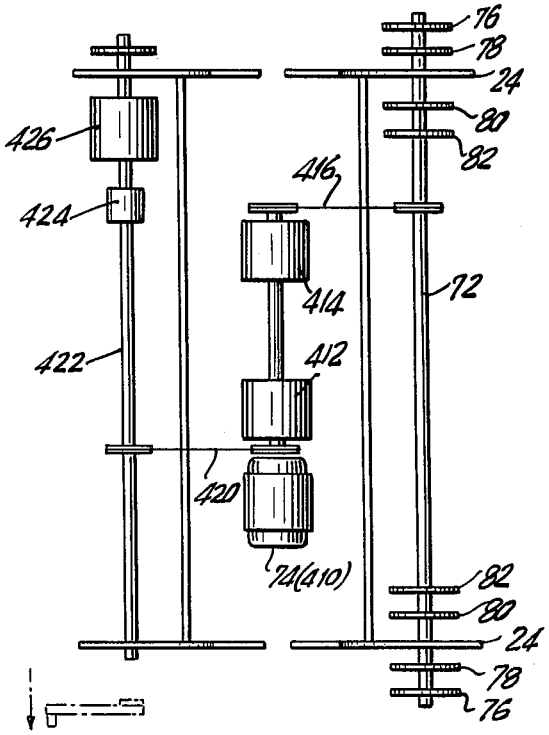
FIG. 17 is a schematic plan view of the drive train.

FIGS. 16 and 17 illustrate a schematic drive arrangement for the apparatus. Basically the apparatus is driven by an electric motor 410 having an output shaft connected by a combination clutch brake mechanism 412, of conventional construction, to a gear reducer 414. A belt or chain drive 416 from the gear reducer drives the cam shaft 72 to rotate the respective cams thereon. The output shaft of the motor 410 is also connected through a pulley or chain drive 420, upstream of clutch 412, to a conveyor drive shaft 422. The latter includes a clutchbrake combination, of conventional construction, connected to a variable drive transmission 426. The output of the variable drive transmission is connected via a chain drive 428 to a main power shaft 430 for conveyors 12, 14. The shaft 430 is connected via a chain drive to an electric clutch 434 in driving engagement with the power shaft 436 of inlet conveyor 12. Shaft 430 is also connected via a chain drive 438 to the power shaft 440 of the outlet conveyor 14.

The specific electrical circuitry for connecting the various electric clutches, brakes and drives in the apparatus is a matter of design, as would be apparent to those skilled in the art, and need not be described herein in detail. However, a key feature of the invention is that the electric clutch 434 is controlled by detecting switch 174 in order to insure that the binding wires are tight and straight beneath the wire manipulating apparatus 20 before the wires are cut. Thus, as container blank B enters the apparatus and a space is detected by lever 176, the electric clutch 434 is deactivated to stop the drive on inlet conveyors 12, while the drive on outlet conveyors 14 continues. Although the blank will continue to move as a result of the pull from the outlet conveyors, the drag from the inlet conveyors will cause the binding wires to tighten and thus straighten into their proper position with respect to the wire manipulating apparatus. After the blank has moved to the intermediate dotted line position thereof illustrated in FIG. 15, switch 174 actuates the clutch-brake mechanism 424 to stop the drive to both of the conveyors 12, 14. At this point the electric clutch 434 is activated.

In operation, as mentioned above, a series of interconnected wirebound container blanks B are supplied to the apparatus 10 from a stitching machine of conventional construction, with the blanks being spaced from one another but interconnected by the integral binding wires. The blanks are fed to the vertically arranged inlet conveyors 12, which vertically grip the edges of the container blanks between their adjacent horizontal flights and pull the blanks through the apparatus. Preferably, the lower horizontal flight of the upper conveyor is spring biased, in any convenient manner, in order to insure a tight gripping engagement on the container blank. The use of vertically arranged conveyors in this manner allows the apparatus to accommodate container blanks of various sizes without the need to adjust the horizontal relationship of the conveyor pairs with respect to one another.

Figure 15:
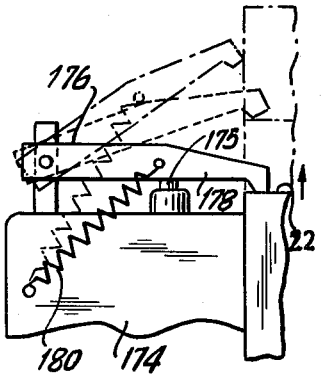
FIG. 15 is an enlarged plan view of a control switch used in the apparatus shown in FIG. 1.

In any case, as the blanks are fed into the machine, the lever arm 176 of switch 174 detects a space between the blanks by moving from its phantom line position in FIG. 15 to its solid line position, thereby actuating the switch 174 and causing electric clutch 434 to deactivate, and arming the apparatus for the performance of a loop cycle. The container blanks continue to move under the pull of outlet conveyors 14, until lever arm 176 is moved from its solid line position to its dotted line position, at which point clutch 434 is activated and the clutch 424 is activated to stop the drive to both conveyors. At the same time clutch 412 is activiated in order to initiate rotation of cam shaft 72. At this position the binding wires in the space or gap between adjacent container blanks are properly positioned beneath the wire manipulating mechanisms 20.

Upon actuation of clutch 412, and rotation of the shaft 84, the first operation which occurs is the lowering of I beam 26 in order to position the wire manipulating apparatus adjacent binding wires 16. As described above, movement of I beam 26 is controlled by the cam and cam followers 78, 78' through levers 134, 140 and the rack bar 150. As the rotation of cam 78 causes the pivot ends 144 of lever 140 to move downwardly, rack bar 150 moves downwardly and the I beam, which is supported on the feet 150 of the rack bar, moves downwardly therewith. (It is noted that the rack bars 150 are provided on only one end of the apparatus, with the opposite end of the eye beam, as illustrated in FIG. 3, being simply connected to a chain 425).

The frame 24 is provided with a cross bar or stop 426 (FIGS. 4 and 5) having an upper surface adapted to engage a stop member 428 on the eye beam to limit downward movement of the I beam. Removable inserts 430 can be positioned on bar 426 in order to adjust the height of the drop of the I beam in accordance with the thickness of the face material being treated in the apparatus. In any case, once the I beam has dropped down (by the lowering of rack bars 150) a sufficient distance to engage stop 428 with bar 426, further downward movement of the I beam is stopped. In this connection, since spindle shafts 254 are mounted on the I beam they move downwardly with the I beam and with the support racks 150, so that no rotation thereof occurs. However, once downward movement of the I beam has stopped, downward movement of support bars 150 continues under the influence of cam 78, so that the support or rack bars are moved relative to spur gears 255 on the ends of the shafts 254, causing the shafts to rotate and in turn drive spindles 32.

Figure 4:
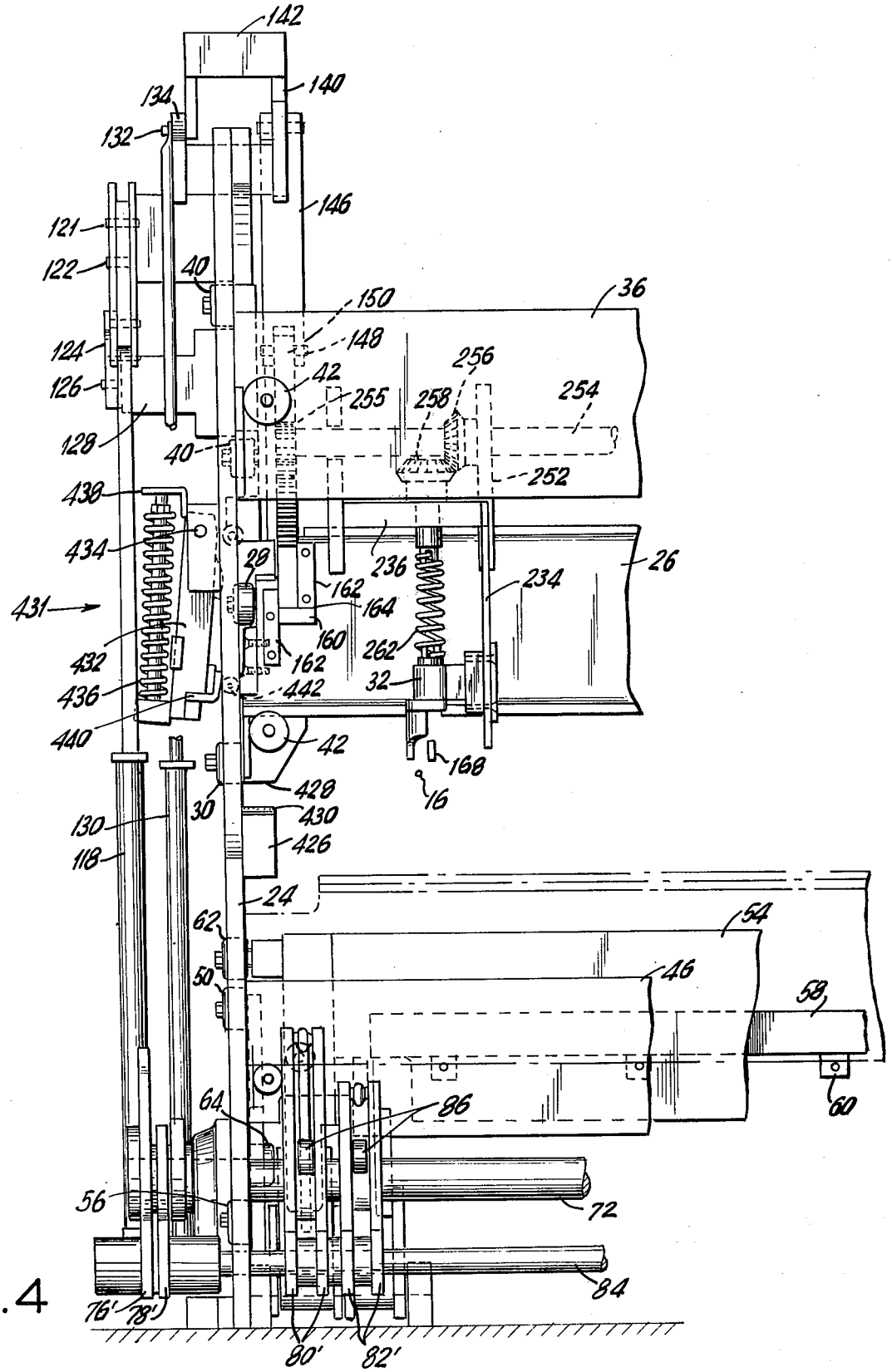
FIG. 4 is an end elevational view of the drive mechanism of the apparatus in position ready for operation.

A latching mechanism 431 is provided at both ends of the apparatus for locking the I beam in its down position at least during the wire cutting portion of the operation. This latch mechanism includes a lever bar 432 pivotally mounted at 434 on frame 24, and spring biased in a counterclockwise direction, as seen in FIG. 4, by a compression spring 436 operatively connected between the lever 432 and an abutment 438 on the frame. Lever 432 includes a step element 440 at its lower end which is moved inwardly over a roller 442 carried on the end of I beam 26 when the I beam has moved to its stop position, as illustrated in FIG. 5. As previously described, when I beam 26 drops down, the lower cutter element 188 is raised by the upward movement of the cutter bar 58 under the influence of cam 80. When I beam 26 has reached its lowermost position, the lower cutter bar 188 moves upwardly to urge wire 16 against cutter bar 186, to sever the binding wire. Because of the upward movement of the lower cutter bar 188, there may be a tendency for the I beam to raise upwardly. The latch 431 prevents such upward movement of the I beam and insures that the cutter block 186 is held firmly in position for a proper cut. In addition, it is noted that the slight upward movement imparted to the binding wire 16 aids in positioning the binding wire between mandrel 168 and spindle 32.

After the cut is made, cam 78 causes rack bars 150 to move downwardly through an incremental movement, from the solid line position thereof in FIG. 5 to the dotted line position. This relative movement of rack bar 150 with respect to spur gears 255 causes rotation of the two spindle shafts 254, thereby rotating spindles 32. Since the wire working mechanisms have been moved downwardly about binding wire 16 by the downward movement of I beam 26, the spindles properly engage the cut binding wire and bend the ends thereof about the mandrels 168 so that the free ends 280 of the binding wires are positioned over the hook-like projections of their associated loop bars.

With the binding wire ends placed on the flat portions 298 of the projections 296, cam 76 operates link 118 to move the second cross bar 36 and its integral cross bar sections 36 downwardly against the top collar 318 of the former driver mechanism. This downward movement, as previously described, initially moves the former and driver bars of each unit 170 in unison, so that the former bar forms prong P and knuckle K in the free end of the binding wire. After a first predetermined distance of movement, the former bar's movement is stopped and the driver bar is released for further movement to drive the prong P through the face material.

Downward movement of cross bar 34 also releases latch 431 to permit upward movement of the I beam at the end of the wire manipulating process. That is, as bar 34 moves down a roller 450 mounted thereon engages a cam surface 452 on lever 432 (FIG. 5A) to pivot it clockwise and disengage members 440, 442. At the lower end of the stroke of bar 34 the extension 454 thereof which carries roller 450 rests on the shoulder 416 formed in I beam 26.

Once prong P is driven, cam member 82 activates clinching bar 44 to raise its bar sections 46 upwardly and drive clinching elements 382 in order to clinch the extreme ends of the binding wires back into the face material of blanks B, B'. When the clinching operation is completed, cam 76 raises cross bar 34 and cam 78 raises beam 26. This upward movement of the I beam allows presser foot 366 of the stripper bar to strip the binding wire loop from the mandrel, while spring 324 begins to move the driver bar upwardly and reposition the various elements for the next operation.. Ultimately, the driver bar, former bar and presser foot are returned to the configuration illustrated in FIG. 9B, as previously described. However, the I beam having moved upwardly, the wire manipulating apparatus is spaced from the face material so that the container blanks are free to move through the apparatus. When all of the cross bars or beams have returned to their original positions, clutch 412 is actuated to stop rotation of cam shaft 72, while the clutch and break mechanism 424 is reactivated to drive conveyors 12, 14.

Accordingly, it is seen that by the apparatus of the present invention, a highly sturdy and durable loop forming mechanism is provided which can substantially automatically form and perpetuate loops in binding wires on wirebound container blanks. The apparatus provides for a simple and reliable mechanism for driving the free end of the binding wire through the face material with little or no danger of bending of the prong and thus with a minimum number of culls. The apparatus is totally adjustable to accommodate as many binding wires as are on the container blank, in substantially in whatever spacing is desired.

Although an illustrative embodiment of the present invention has been described herein with reference to the accompanying drawings, it is to be understood that various changes and modifications may be effected therein by one skilled in the art without departing from the scope of spirit of this invention.

What is claimed is:

1. A prong forming and driving mechanism for use in a loop forming and fastening machine for making wirebound container blanks, said mechanism being adapted to be mounted on a first vertically reciprocal crossbar in the loop forming machine for movement therewith and being operated by a second vertically reciprocal crossbar in the machine, said mechanism including a housing operatively connected to said first crossbar for movement in unison therewith, a wire former bar slidably mounted in said housing for vertical reciprocal movement, a loop bar pivotally mounted on said housing for movement in a transverse vertical plane with respect to said former bar and having a lower end including a hook-like projection arranged to project beneath the free end portion of a binding wire extending beyond said projection from one side of a loop formed in the binding wire, said former bar having a lower end portion including an inner face generally coplanar with the plane of movement of the adjacent inner face of the loop bar and having a vertical groove formed therein for receiving said free end portion of said binding wire; a drive bar, including a lower end, being slidably mounted in said housing adjacent said former bar for vertical reciprocal movement with respect to said former bar and housing in the vertical plane of said loop bar, with said lower end thereof being normally located above said hook-like projection and above the level of the lower end of the former bar; said driver bar being adapted to be moved vertically downwardly in said housing by spring means being operatively connected between said driver bar and said housing for normally biasing said driver bar to a first uppermost position with respect to the housing; first means operatively connecting said driver bar to said former bar for holding the former bar with the driver bar in said uppermost vertical position with the lower end of the driver bar at a level above the lower end of the former bar, while allowing downward vertical movement of said driver bar with respect to said former bar under the influence of said second crossbar; second means operatively and simultaneously engaging the lower end of said driver bar, said former bar and a portion of said housing for initially preventing relative downward movement of said driver bar with respect to the former bar under the influence of the second crossbar whereby the driver bar and former bar move downwardly together for a predetermined distance until the former bar has been moved downwardly with respect to loop bar and bent the portion of the binding wire extending beyond the loop bar downwardly around the loop to form a prong in the vertical groove and for thereafter releasing said drive bar for further downward movement with respect to the former bar and housing under the influence of said second crossbar, said driver bar including cam means cooperating with said loop bar for pivoting said loop bar outwardly from beneath said binding wire as, and after, the driver bar is released for further downward movement whereby said wire prong is driven into the face material of the container blank with the prong being supported, as it is driven, on one side by said loop bar and on its other sides by the walls of said groove in the former bar.

2. The mechanism as defined in claim 1 including spring means operatively connected between said loop bar and said housing for biasing said loop bar in a predetermined direction to normally maintain said hook-like projection below the lower end of the driver bar until the loop bar is moved by said cam means.

3. The mechanism as defined in claim 2 wherein said first means comprises an elongated vertical slot formed in one of said driver and former bars and a pin mounted in the other of said driver and former bars and located to engage said slot in a predetermined position to hold the former bar in a raised position with respect to the housing when the driver bar is in its uppermost position.

4. The mechanism as defined in claim 3 wherein said former bar has an elongated slot formed therein extending transversely of the vertical path of travel of the driver bar, said housing has a cam surface formed thereon adjacent the inner face of the former bar facing said loop bar and being inclined downwardly and away from the loop bar; and said second means comprises a roller rotatably and slidably positioned in said slot for simultaneously engaging the lower end of said driver bar and said cam surface; said lower end of the driver bar having a first cam surface portion engaging said roller and biasing the roller towards the cam surface of said housing and said slot having a predetermined length selected such that when said former bar has been moved downwardly with the driver bar said predetermined distance, the roller is moved in said slot out of position beneath the driver bar whereby the driver bar is freed for further downward movement with respect to the former bar to drive said prong.

5. The mechanism as defined in claim 3 wherein said driver bar has an extension portion received in the groove of the former bar for engaging the upper portion of said prong and applying an axially directed driving force thereto.

6. The mechanism as defined in claim 4 wherein said hook-like projection includes a first flat horizontal section on which said binding wire is initially positioned and a second tapered section inclined downwardly and away from said flat section.

7. The mechanism as defined in claim 6 wherein said cam means for pivoting the loop bar comprises i) a first cam surface on the loop bar and a second cam surface on the driver bar for engaging the cam surface on the loop bar and pivoting the loop bar outwardly when the driver bar is released by said roller until the flat section of the projection is moved from beneath said binding wire; and ii) a second cam surface on the lower end of said driver bar for engaging said tapered portion of the projection and moving the loop bar out from beneath said binding wire as the driver bar continues its downward movement, whereby outward movement of said loop bar results in reducing the effective height of the inner face of said hook-like projection in synchronism with the shortening of the portion of said prong remaining exposed above the face material of the container blank.

8. The mechanism as defined in claim 1 including means adapted to be mounted on said first crossbar above the plane of said container blank for forming a loop in the binding wire and positioning said free end portion thereof over said loop bar projection.

9. The mechanism as defined in claim 4 wherein said former bar includes a pair of spaced former bar sections respectively located to be positioned on opposite sides of said projection when said former and driver bars have been moved downwardly said predetermined distance.

10. The mechanism as defined in claim 9 wherein said spaced former bar sections define a slot therebetween and said driver bar is positioned in said slot.

11. The mechanism as defined in claim 4 including a stripper bar slidably mounted in said housing for movement with said former bar but on the side of said loop bar opposite said grooved inner face of said former bar, said stripper bar including a presser foot adapted to hold said loop against the container blank while said prong is driven.

12. The mechanism as defined in claim 11 including means operatively connecting said stripper bar to said former bar for allowing relative vertical upward movement of said former bar, with the driver bar, before upward movement of said stripper bar.

13. The mechanism as defined in claim 12 wherein said means connecting the former bar to the stripper bar includes an elongated pin mounted in said former bar transversely of the plane of movement of the loop bar and an elongated slot formed in said stripper bar for receiving said pin, said slot being formed such that the pin is located adjacent the bottom end of the slot upon completion of driving of the prong whereby upward movement of the driver bar under the influence of the first mentioned spring means will: i) move the driver bar up along a predetermined distance limited by the engagement of elongated vertical slot and pin in said former and driver bars, ii) then move the driver and former bars upwardly together and; iii) move the stripper bar upwardly when the pin in the former bar engages the upper end of the slot in the stripper bar, said presser foot engaging a portion of said housing after moving upwardly a predetermined distance to limit upward movement of said former and driver bars under the influence of said first mentioned spring means.

14. The mechanism as defined in claim 1 including cooperating abutment means on said former bar and said housing for limiting downward movement of said former bar to said predetermined distance.

15. A prong forming and driving mechanism for use in a loop forming and fastening machine for making wirebound container blanks, said mechanism being adapted to be mounted on a first vertically reciprocal crossbar in the loop forming machine for movement therewith and being operated by engagement with a second vertically reciprocal crossbar in the machine upon downward movement thereof; said mechanism including a housing operatively connected to said first crossbar for vertical movement in unison therewith wherein downward movement of said first crossbar places said mechanism in position for operation; a wire former bar slidably mounted in said housing for vertical reciprocal movement, said former bar having first and second spaced former bar sections having lower end portions and defining a vertical slot therebetween; a loop bar pivotally mounted on said housing for movement in a transverse vertical plane with respect to said former bar in vertical alignment with said slot; said loop bar having a lower end including a hook-like projection dimensioned to fit in said slot between said former bar sections and arranged to project beneath the free end portion of a binding wire extending beyond said projection from one side of a loop in the binding wire; said first former bar section having an inner face generally coplanar with the plane of movement of the adjacent inner face of the loop bar and having a vertical groove formed therein for receiving said free end portion of said binding wire; a driver bar, having a lower end, being slidably mounted in said housing in the slot between said former bar sections for vertical reciprocal movement with respect to said former bar and housing in the vertical plane of said loop bar, with said lower end of the driver bar being normally located above said hook-like projection and above the level of the lower ends of said former bar sections; said driver bar having an upper end positioned for engagement by said second crossbar during downward movement thereof for operating said mechanism; first spring means operatively connected between said upper end of the driver bar and said housing for normally biasing said driver bar to a first uppermost position with respect to the housing; said driver bar having an elongated vertical slot formed therein having upper and lower ends; and said former bar having a first pin mounted therein and received in said slot; said first pin being located to engage the lower end of the vertical slot in the driver bar as the driver bar is urged upwardly by said first spring means whereby the driver bar holds the former bar with it in said uppermost position, while the slot in the driver bar allows the driver bar to be moved downwardly with respect to the former bar under the influence of said second crossbar; said former bar sections having parallely extending elongated grooves formed therein facing each other and extending transversely of the vertical path of travel of the driver bar; a roller rotatably mounted at opposite ends in said grooves for rotation therein and transverse movement across the slot between said former bar sections; said housing having a cam surface formed thereon and extending into said slot between the former bar sections, facing said loop bar, and being inclined downwardly and away from the loop bar in engagement with said collar; said lower end portion of the driver bar having a first cam surface portion engaging said roller and biasing the roller into engagement with the housing cam surface whereby said roller selectively blocks vertical movement of the driver bar whereby the former bar and driver bar initially move downwardly in unison under the influence of the downward movement of the second crossbar; said grooves in the former bar sections having a predetermined length and the housing cam surface having a predetermined inclination selected such that when the former and driver bars have been moved downwardly together a predetermined distance such that the former bar sections have bent the portion of the binding wire extending beyond the loop bar downwardly around said hook-like projection to form a prong in the vertical groove of said first former bar section, the roller has moved out of its blocking position beneath the driver bar whereby the driver bar may continue its downward movement under the influence of said second crossbar to drive the prong into the face material of the container-blank; said driver bar including cam means cooperating with said loop bar for pivoting said loop bar outwardly from beneath the binding wire as, and after, the driver bar is released for further downward movement by the roller whereby as the prong is driven by the driver bar it is completely surrounded and supported, on one side by said loop bar and on its other side by the walls of said vertical groove in the first former bar section.

16. The mechanism as defined in claim 15 including second spring means operatively connected between said loop bar and said housing for biasing said loop bar in a predetermined direction to normally maintain said hook-like projection below the lower end of the driver bar in vertical alignment with the vertical slot between said former bar sections until the loop bar is moved by said cam means.

17. The mechanism as defined in claim 16 wherein said hook-like projection includes a first flat horizontal section on which said binding wire is initially positioned and a second tapered section inclined downwardly and away from said flat section.

18. The mechanism as defined in claim 17 wherein said cam means for pivoting the loop bar comprises i) a first cam surface on the loop bar and a second cam surface on the driver bar for engaging the cam surface on the loop bar and pivoting the loop bar outwardly when the driver bar is released by said roller until the flat section of the projection is moved from beneath said binding wire; and ii) a second cam surface on the lower end of said driver bar for engaging said tapered portion of the projection and moving the loop bar out from beneath said binding wire as the driver bar continues its downward movement, whereby outward movement of said loop bar results in reducing the effective height of the inner face of said hook-like projection in synchronism with the shortening of the portion of said prong remaining exposed above the face material of the container blank.

19. The mechanism as defined in claim 18 including a stripper bar slidably mounted in said housing for movement with said former bar and being positioned adjacent said second former bar section; said stripper bar including a pressure foot adapted to hold said loop against the container blank while said prong is driven.

20. The mechanism as defined in claim 19 including means operatively connecting said stripper bar to said former bar for allowing relative vertical upward movement of said former bar, with the driver bar, before upward movement of said stripper bar.

21. The mechanism as defined in claim 20 wherein said driver bar has an extension portion received in the vertically extending groove of the first former bar section for engaging the upper portion of said prong and applying an axially directed driving force thereto.

22. The mechanism as defined in claim 12 wherein said means connecting the former bar to the stripper bar includes a second elongated pin mounted in said second former bar section transversely of the plane of movement of the loop bar, and an elongated slot formed in the stripper bar for receiving said second pin, said slot being formed such that said second pin is located adjacent the bottom of the slot in said second former bar section upon completion of driving of the prong whereby upward movement of the driver bar under the influence of said first spring means, during upward movement of said second crossbar, will:

i) move the driver bar up along a predetermined distance limited by the engagement of said first pin in the former with the bottom of the slot in the driver bar;

ii) then move the driver and former bars upwardly in unison, and iii) move the stripper bar upwardly when the second pin in said second former bar section engages the upper end of the slot in said stripper bar; said presser foot engaging a portion of said housing after being moved upwardly a predetermined distance thereby to limit upward movement of said former and driver bars under the influence of said first spring means.

23. The mechanism as defined in claim 15 including means adapted to be mounted on said first crossbar above the plane of said container blank for forming a loop in the binding wire and positioning said free end portion thereof over said loop bar projection.

24. Apparatus for forming loop fasteners on wire-bound container blanks wherein wire manipulations are performed on a wire section secured to a container blank to form a loop in the wire and drive the end of the wire into the container blank to perpetuate the loop, said apparatus comprising a frame defining a path of travel therethrough for the container blank, first and second crossbars respectively vertically reciprocally mounted in said frame above and transversely of the path of travel of said container blank for movement between upper and lower positions, means for vertically reciprocating said crossbars in accordance with a predetermined sequence, wire manipulating means mounted on said first crossbar above the path of travel of said container blank including means for bending said wire section into a loop when the first crossbar is in its lower position, and means positioned to be engaged and driven by said second crossbar during downward movement thereof for forming a prong in said wire section, after said loop is formed, and driving the prong into the container blank material.

25. Apparatus as defined in claim 24 including a third crossbar mounted in said frame for reciprocal vertical movement, below the path of travel of said container blank, means for moving said third crossbar between upper and lower positions; and prong clinching means mounted on said frame and positioned to be actuated by said third crossbar during upward movement thereof for bending the free end of the wire driven through the container blank material back into the material.

26. Apparatus as defined in claim 25 including means for adjustably mounting said wire manipulating means and said clinch means on said first crossbar and frame.

27. Apparatus as defined in claim 25 including a fourth crossbar vertically reciprocally mounted in said frame below the path of travel of said container blank between upper and lower positions, means for moving said fourth crossbar between said upper and lower positions; cutter means mounted on said frame below the path of travel of said container blank in vertical alignment with said first crossbar and positioned for operation by the upward movement of said cutter means for the crossbar; said cutter means including a cutter bar having a sharp edge extending transversely of the path of travel of the container blank and wire, and said first cross bar having cooperating cutter element mounted on its lower face, and said means for moving the first and fourth crossbar being operated in synchronism such that when the first crossbar is moved to its lowermost position the fourth crossbar is moved to its uppermost position and said cutter bar and cutting element cooperate to sever the wire before the loop is formed, and form a point in the wire on its uppermost side, which point, after the wire prong is formed, driven and clinched, enters the blank material and is substantially unexposed.

28. Apparatus as defined in claim 27 including means for locking said first crossbar in its downward position against upward movement at least during upward movement of said fourth crossbar.

29. Apparatus as defined in claim 28 wherein said second crossbar includes means for releasing said locking means as it is moved downwardly after the cutting operation thereby freeing the first crossbar for upward movement after the cutting and clinching operations.

30. Apparatus as defined in claim 24 wherein said means for forming the loop in the wire comprise a relatively flat mandrel extending in the direction of travel of the container blank and located to be positioned on one side of a wire passing through the apparatus, and a spindle rotatably mounted on said first crossbar above the path of travel of the container blank and including a surface portion normally positioned adjacent to and spaced from the mandrel on the other side of a wire passing through the apparatus, and means for rotating said spindle above the mandrel when said first crossbar is in its lower position to form said loop in the wire.

31. Apparatus as defined in claim 30 wherein said means for moving said first crossbar between said upper and lower positions includes a first link slidably mounted on said first crossbar for vertical movement with respect thereto, said first link and first crossbar having cooperating abutment surfaces positioned such that upward movement of the first link will cause upward movement of the first crossbar when the abutment surfaces are engaged, said moving means including means for reciprocating said first link vertically to raise and lower first crossbar.

32. Apparatus as defined in claim 31 wherein said frame includes stop means for engaging said first crossbar during downward movement thereof to define the lower position of the first crossbar while the slidable mounting of the first link on the first crossbar permits continued downward movement thereof; said means for driving said spindle being operatively connected to said first link for rotating the spindle in response to said continued movement of the first link.

33. Apparatus as defined in claim 32 wherein said first link has a rack gear surface formed thereon and said means for rotating the spindle include a gear train mounted on said first crossbar in operating engagement with said each gear surface whereby said gear train is not operated during downward movement of said first crossbar but is operated during said continued movement of the first link to rotate said spindle to form said loop, and wherein upward movement of said first link initially causes rotation of the spindle in an opposite direction to its initial position, until said abutment surfaces are again engaged, and further upward movement causes said first crossbar to return to its upper position.

34. Apparatus as defined in claim 33 wherein said spindle gear train includes a universal joint connecting defined by a coiled spring operatively connected in driving relation between the spindle and a section of the gear train.

35. Apparatus as defined in claim 24 including conveyor means for guiding a strip of spaced container blanks interconnected by a length of binding wire; means on said apparatus for detecting a space between successive container blanks and for stopping said conveyors with the space between the blanks in a predetermined position with respect to said wire manipulating means.

36. Apparatus as defined in claim 35 including means for cutting said binding wire in said space between the container blanks when the blanks are stopped and before said loop is formed; and second wire manipulating means located in alignment with the first mentioned wire manipulating means whereby both cut ends of the binding wire are manipulated by the apparatus.

37. Apparatus as defined in claim 36 wherein said conveyor means include inlet and outlet conveyors and drive means therefor; said drive means including means responsive to said detecting means for stopping said inlet conveyor before said outlet conveyor thereby to tighten the binding wires between container blanks before the cutting and loop forming operations.

38. Apparatus as defined in claim 26 wherein said means for mounting said clincher means on said frame comprises, a pair of frame members extending transversely of and below the path of travel of the container blank, a pair of side plates slidably mounted on said frame members for movement therealong, a support bar secured to and extending between said slide plates; said clincher means being mounted on said support bar; and clamp means operatively connected to the slide plates for selectively clamping the slide plates in a fixed position on the frame members.

39. Apparatus as defined in claim 38 including rack gear means extending along said frame members; a pair of spur gears rotatably mounted on said slide bars in engagement with said rack gears, and means for rotating said gears when said clamping means is released, to vary the position of the mounting means for the clincher.

40. Apparatus for forming loop fasteners on wire-bound container blanks wherein wire manipulations are performed on a wire section secured to a container blank to form a loop in the wire and drive the end of the wire into the container blank to perpetuate the loop, said apparatus comprising a frame defining a path of travel therethrough for container blanks; and wire manipulating means mounted in said frame above the path of travel of the container blank, for bending a straight wire section on the container blank into a loop having a free end, bending the free end of the loop into a generally vertically extending prong and driving the prong through the face material of the blank for perpetuating the loop; said wire manipulating means including a generally vertically extending mandrel located above the path of travel of the wire and positioned on one side of the path of travel of the wire; a separate generally vertically extending spindle element also mounted above the path of travel of the wire and positioned on the side of the path of travel of the wire opposite the mandrel; said spindle element comprising a curved vertically extending member defining a portion of a cylindrical wall; and means for rotating the spindle about the mandrel with the wire therebetween to bend the wire in a generally horizontal plane about the mandrel to form said loop; and a first cross bar mounted in said frame for vertical reciprocal movement above the path of travel of the container blanks and means for reciprocating said first cross bar between upper and lower positions with respect to the path of travel of said container blanks; said wire manipulating means being mounted on said first cross bar and positioned, in the lower position of the cross bar, for engaging and manipulating said wire.

41. The apparatus as defined in claim 40 wherein said container blanks are supplied to the apparatus in sections interconnected by at least one continuous binding wire and said apparatus includes means for cutting the wire prior to bending by said spindle element.

42. The apparatus as defined in claim 40 wherein said wire manipulating means includes a housing having wire former and driver means slidably mounted therein for forming the prong on the free end of the wire and for driving the prong through the blank material; said apparatus including a second crossbar vertically reciprocally mounted in the frame above and across the path of travel of said container blank for movement between upper and lower positions and located to engage said former and driver means during downward movement towards its lower position to operate said former and driver means.

43. Apparatus as defined in claim 42 wherein said first crossbar has a first cutter bar mounted on its lower surface in position to be directly above said wire when the first crossbar is in its lower position, and a third crossbar mounted in said frame for reciprocal vertical movement, below the path of travel of said container blank; a second cutter bar mounted on said frame below the path of travel of the container blank in vertical alignment with the first cutter bar for vertical reciprocal movement; and means for moving said third crossbar between lower and upper positions to drive said second cutter bar upwardly towards the first cutter bar to cut said wire before bending by said spindle and mandrel.

44. Apparatus as defined in claim 43 including means for locking said first crossbar in its downward position against upward movement at least during upward movement of the third crossbar.

45. Apparatus as defined in claim 44 wherein said second crossbar includes means for releasing said locking means as the second crossbar is moved downwardly after the cutting operation thereby freeing the first cutter bar for upward movement by its moving means after the cutting, and prong forming and driving operations.

46. Apparatus as defined in claim 45 wherein said means for moving said first crossbar between said upper and lower positions includes a first link slidably mounted on said first crossbar for vertical movement with respect thereto, said first link and first crossbar having cooperating abutment surfaces positioned such that upward movement of the first link will cause upward movement of the first crossbar when the abutment surfaces are engaged, said moving means including means for reciprocating said first link vertically to raise and lower said first crossbar.

47. Apparatus as defined in claim 46 wherein said frame includes stop means for engaging said first crossbar during downward movement thereof to define the lower position of the first crossbar while the slidable mounting of the first link on the first crossbar permits continued downward movement thereof; said means for driving said spindle being operatively connected to said first link for rotating the spindle in response to said continued movement of the first link.

48. Apparatus as defined in claim 47 wherein said first link has a rack gear surface formed thereon and said means for rotating the spindle include a gear train mounted on said first crossbar in operative engagement with said each gear surface where said gear train is not operated during downward movement of said first crossbar but is operated during said continued movement of the first link to rotate said spindle to form said loop, and wherein upward movement of said first link initially causes rotation of the spindle in an opposite direction to its initial position, until said abutment surfaces are again engaged, and further upward movement causes said first crossbar to return to its upper position.

49. A prong forming and driving mechansim for use in a loop forming and fastening machine for making wirebound container blanks, said mechanism being mounted in said loop forming machine for vertical reciprocal movement between an upper inoperative position and a lower operating position adjacent the upper face of the container blank, said prong forming and driving mechanism including a vertically extending relatively straight mandrel positioned to be located, in the operative position of said mechanism, above the blank and adjacent one side of the wire; a rotatable vertically extending spindle positioned to be located, in the operative position of said mechanism, above the blank and adjacent the opposite side of the wire from said mandrel; means for rotating said spindle about the mandrel with the wire therebetween to bend the wire in a generally horizontal plane about the mandrel to form said loop; and means for forming a prong in the end of said wire, after the loop is formed, and driving the prong into the blank material.

50. Apparatus as defined in claim 49 wherein said spindle element is a curved vertically extending member defining a portion of a cylindrical wall.

* * * * *